US011281139B2

(12) United States Patent
Doda et al.

(10) Patent No.: US 11,281,139 B2
(45) Date of Patent: Mar. 22, 2022

(54) FIXING APPARATUS INCLUDING HEAT GENERATING ELEMENT, AND IMAGE FORMING APPARATUS

(71) Applicant: Canon Kabushiki Kaisha, Tokyo (JP)

(72) Inventors: Kazuhiro Doda, Kanagawa (JP); Tsuguhiro Yoshida, Kanagawa (JP); Atsushi Nakamoto, Tokyo (JP); Shoichiro Ikegami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/109,302

(22) Filed: Dec. 2, 2020

(65) Prior Publication Data

US 2021/0165351 A1 Jun. 3, 2021

(30) Foreign Application Priority Data

Dec. 3, 2019 (JP) ..... JP2019-218600

(51) Int. Cl.
*G03G 15/20* (2006.01)

(52) U.S. Cl.
CPC ..... *G03G 15/2053* (2013.01); *G03G 15/2064* (2013.01)

(58) Field of Classification Search
CPC ..... G03G 15/2039; G03G 15/2042; G03G 15/2053; G03G 2215/2003
See application file for complete search history.

(56) References Cited

U.S. PATENT DOCUMENTS 5,068,517 A * 11/1991 Tsuyuki ..... H05B 3/265 219/543
2006/0000819 A1 1/2006 Makiharra et al.
2014/0169845 A1 6/2014 Nakahara et al.
2015/0037052 A1 2/2015 Muramatsu et al.

FOREIGN PATENT DOCUMENTS

EP 0360418 A 3/1990
EP 3185077 A 6/2017
JP 10260599 A 9/1998
JP 2017097147 A 6/2017
JP 2017227876 A 12/2017

OTHER PUBLICATIONS

Extended European Search Report dated Apr. 7, 2021 in corresponding European Patent Appln. No. 20208284.8.

* cited by examiner

*Primary Examiner* — Thomas S Giampaolo, II
(74) *Attorney, Agent, or Firm* — Venable LLP

(57) ABSTRACT

A fixing apparatus including a heat generating element having a first area, a second area, and a third area, the first area being located on an end portion side in an orthogonal direction orthogonal to a conveyance direction of a recording material and having a first heat generation amount per unit length in the orthogonal direction, the second area being located on an inner side than the first area in the orthogonal direction and having a second heat generation amount per unit length in the orthogonal direction, the third area being located on the inner side than the second area in the orthogonal direction and having a third heat generation amount per unit length in the orthogonal direction. The second heat generation amount is larger than the third heat generation amount, and the third heat generation amount is larger than the first heat generation amount.

24 Claims, 17 Drawing Sheets

(LTR SHEET)

(A4 SHEET)

(LTR SHEET)

(A4 SHEET)

(LTR SHEET)

(A4 SHEET)

FIG. 13A
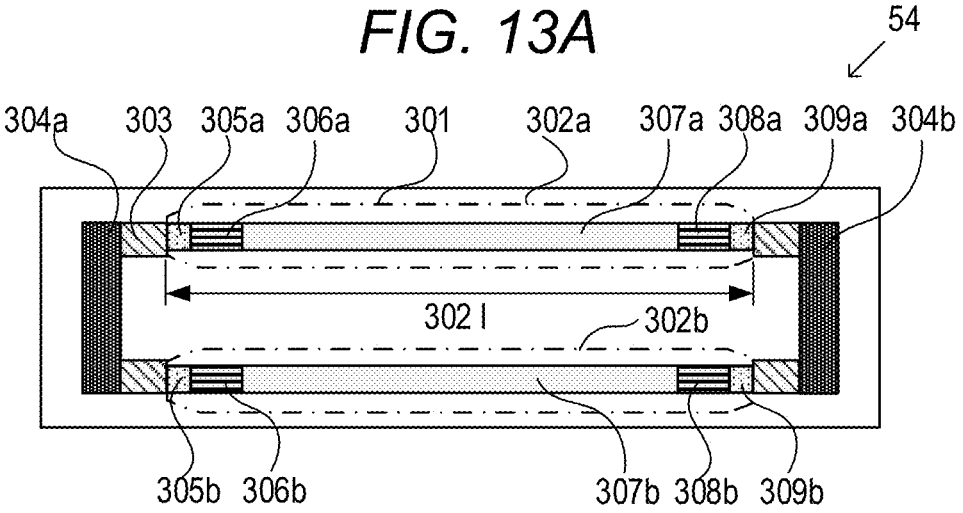
FIG. 13B
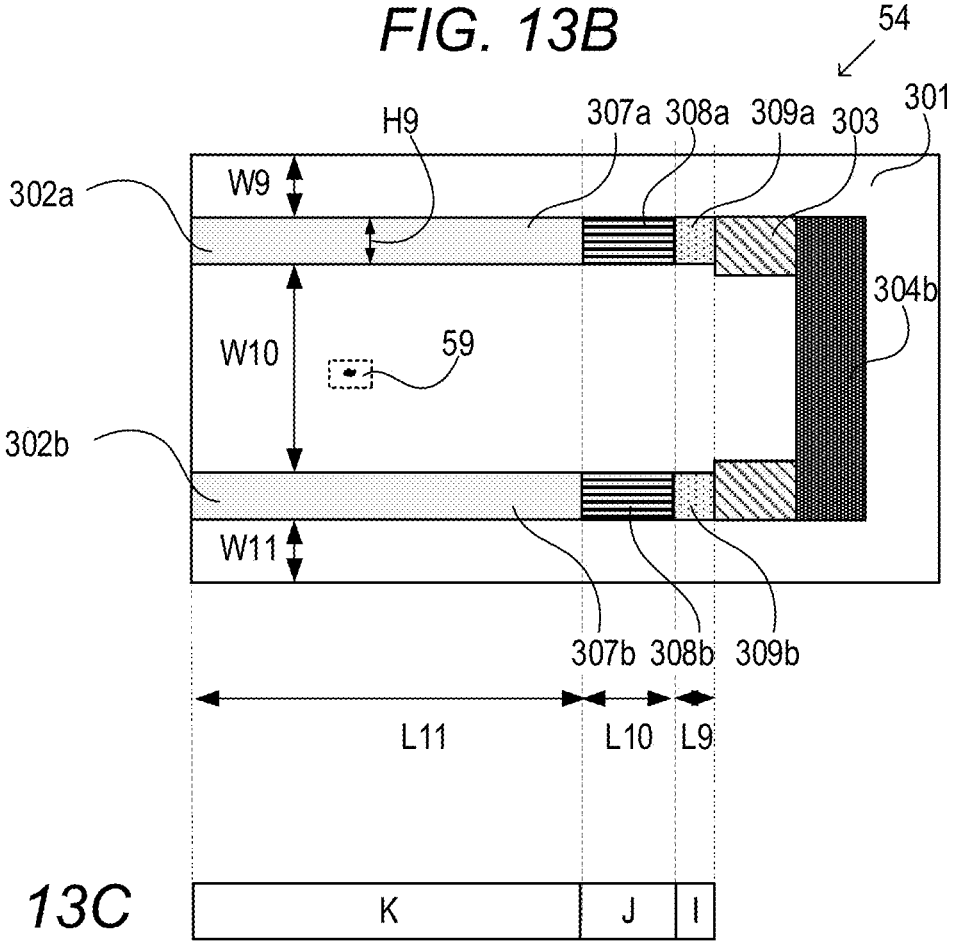
FIG. 13C

FIG. 14A
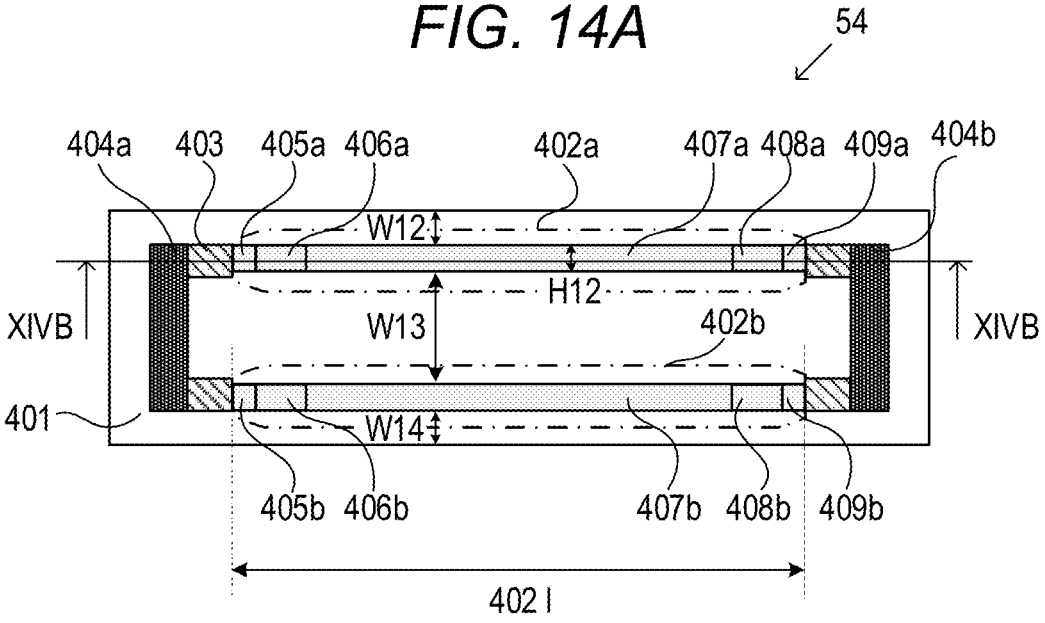
FIG. 14B
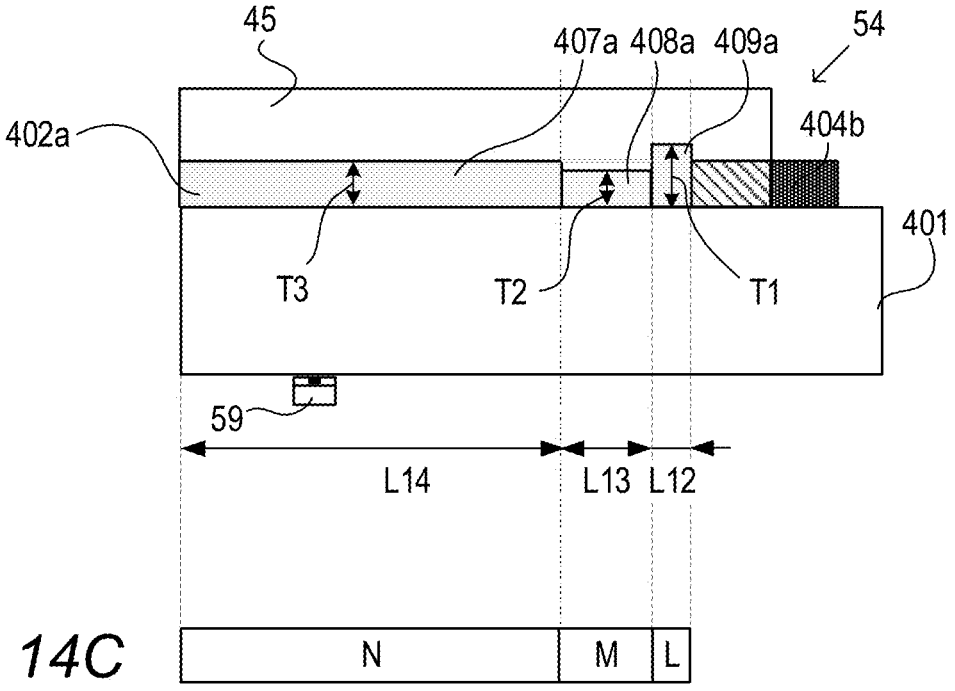
FIG. 14C (A3 SHEET)

(LTR SHEET)

FIXING APPARATUS INCLUDING HEAT GENERATING ELEMENT, AND IMAGE FORMING APPARATUS

BACKGROUND OF THE INVENTION

Field of the Invention

The present invention relates to a fixing apparatus and an image forming apparatus, and more particularly, to a fixing apparatus provided in an image forming apparatus, such as a laser printer, a copying machine, or a facsimile, using an electrophotographic recording method.

Description of the Related Art

A fixing apparatus of a film heating type includes a heater substrate inside a fixing film, and further includes a pressure roller provided in contact with the fixing film. Members such as the fixing film and the pressure roller are generally longer than a heat generating element. An end portion of each of the members in a longitudinal direction thereof is more liable to drop in temperature as compared to a central portion thereof, and thus the end portion tends to be reduced in fixability of toner to a sheet. The drop in temperature at an end portion of a member in a longitudinal direction is hereinafter referred to as "end temperature sagging." As a method of suppressing the end temperature sagging, for example, there has been proposed a method involving narrowing a width (length in a widthwise direction) of a heat generating element at both end portions in a longitudinal direction thereof, to thereby set an electric resistance value per unit length of the end portion to be larger than that of a central portion in the longitudinal direction (see, for example, Japanese Patent Application Laid-Open No. H10-260599). With this configuration, a larger heat generation amount can be obtained at both the end portions in the longitudinal direction than at the central portion in the longitudinal direction, and thus the end temperature sagging of each of the members can be suppressed.

In a case in which the related-art heat generating element is used, temperature rise at a non-sheet passing portion is less liable to occur when a sheet having a large width in the longitudinal direction is caused to pass through the fixing apparatus. However, when a sheet having a small width in the longitudinal direction is caused to pass through the fixing apparatus, the temperature rise at the non-sheet passing portion may occur such that both end areas through which no sheet passes are excessively heated. A length of a sheet in a longitudinal direction (sheet width) thereof is referred to as "longitudinal sheet width (W)."

For example, in a printer adapted to an A4-sized sheet, a sheet size having the largest longitudinal sheet width is LTR (W=215.9 mm), and a sheet size having the second largest longitudinal sheet width is A4 (W=210 mm). The LTR sheet and the A4 sheet are both conveyed with their short sides being oriented as a leading edge in a conveyance direction. For example, in a case in which the related-art heat generating element is mounted on an A4 printer, when the A4 sheet having a longitudinal sheet width smaller than that of the LTR sheet is conveyed, the area of the non-sheet passing portion is wider than that in the case of the LTR sheet, and hence excessive temperature rise may occur at the non-sheet passing portion.

SUMMARY OF THE INVENTION

According to an embodiment, there is provided a fixing apparatus configured to fix an unfixed toner image borne on a recording material, the fixing apparatus comprising a heat generating element having a first area, a second area, and a third area, the first area being located on an end portion side in an orthogonal direction orthogonal to a conveyance direction of the recording material and having a first heat generation amount per unit length in the orthogonal direction, the second area being located on an inner side than the first area in the orthogonal direction and having a second heat generation amount per unit length in the orthogonal direction, the third area being located on the inner side than the second area in the orthogonal direction and having a third heat generation amount per unit length in the orthogonal direction, wherein the second heat generation amount is larger than the third heat generation amount, and the third heat generation amount is larger than the first heat generation amount.

Further features of the present invention will become apparent from the following description of exemplary embodiments with reference to the attached drawings.

BRIEF DESCRIPTION OF THE DRAWINGS

FIG. 13A is a plan view of a heater in the third embodiment.

FIG. 13B is an enlarged view of a right half of the heater in the third embodiment.

FIG. 13C is a view for illustrating a first area, a second area, and a third area.

FIG. 14A is a plan view of a heater in the fourth embodiment.

FIG. 14B is a sectional view taken along the line XIVB-XIVB of FIG. 14A, of a right half of the heater in the fourth embodiment.

FIG. 14C is a view for illustrating the first area, the second area, and the third area.

DESCRIPTION OF THE EMBODIMENTS

Now, embodiments of the present invention are described with reference to the drawings. In the following embodiments, an operation of passing a recording sheet through a fixing nip portion is referred to as "sheet passing." Further, in an area in which a heat generating element generates heat, an area through which no recording sheet passes is referred to as "non-sheet passing area (or non-sheet passing portion)," and an area through which the recording sheet passes is referred to as "sheet passing area (or sheet passing portion)." Further, a phenomenon in which the non-sheet passing area is increased in temperature as compared to the sheet passing area is referred to as "temperature rise at the non-sheet passing portion." Further, members such as a film and a pressure roller are longer than the heat generating element, and hence both end portions of each of the members in a longitudinal direction thereof are more liable to drop in temperature as compared to a central portion thereof. The drop in temperature at both end portions of a member in a longitudinal direction is referred to as "end temperature sagging."

First Embodiment

[Overall Configuration]

Figure 1:
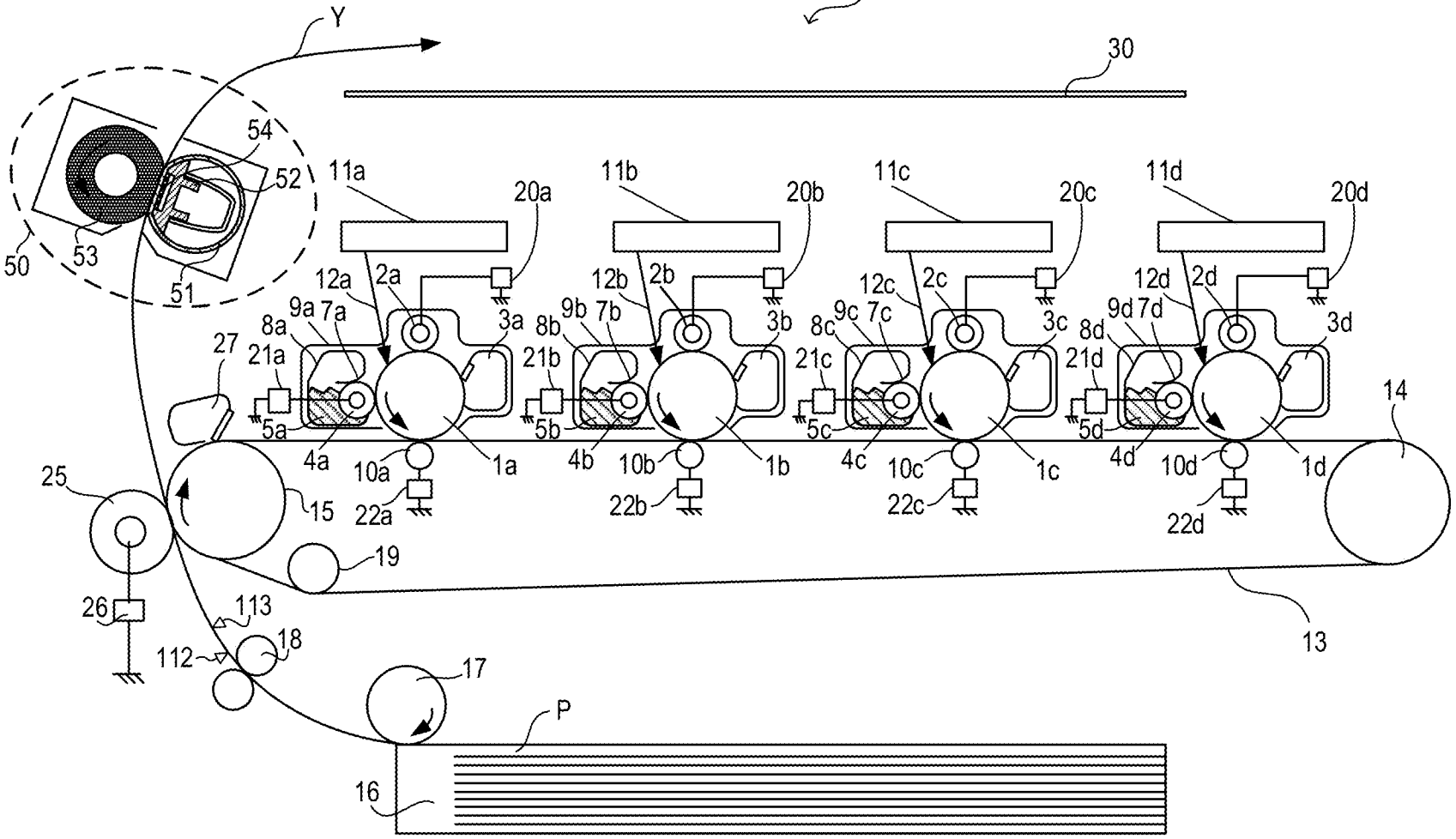
FIG. 1 is a schematic overall configuration view of an image forming apparatus according to each of a first embodiment, a second embodiment, a third embodiment, a fourth embodiment, and a fifth embodiment.

FIG. 1 is a configuration view for illustrating an inline-type color image forming apparatus being an image forming apparatus 170 having mounted thereon a fixing apparatus according to a first embodiment as an example. With reference to FIG. 1, an operation of an electrophotographic color image forming apparatus is described. A first station corresponds to a station for forming a toner image of a yellow (Y) color, and a second station corresponds to a station for forming a toner image of a magenta (M) color. Further, a third station corresponds to a station for forming a toner image of a cyan (C) color, and a fourth station corresponds to a station for forming a toner image of a black (K) color.

In the first station, a photosensitive drum 1*a* serving as an image bearing member is an OPC photosensitive drum. The photosensitive drum 1*a* is formed by laminating a plurality of layers of functional organic materials including, for example, a carrier generating layer formed on a metal cylinder to generate charges through light exposure, and a charge transporting layer for transporting the generated charges. The outermost layer has a low electric conductivity and is almost insulated. A charging roller 2*a* serving as a charging unit is brought into abutment against the photosensitive drum 1*a*. Along with the rotation of the photosensitive drum 1*a*, the charging roller 2*a* is rotated in association therewith to uniformly charge the surface of the photosensitive drum 1*a*. The charging roller 2*a* is applied with a voltage on which a DC voltage or an AC voltage is superimposed, and the photosensitive drum 1*a* is charged by causing discharge at minute air gaps on the upstream and the downstream in a rotation direction from a nip portion between the charging roller 2*a* and the surface of the photosensitive drum 1*a*. A cleaning unit 3*a* is a unit configured to remove toner remaining on the photosensitive drum 1*a* after transfer to be described later. A developing unit 8*a* serving as a developing device includes a developing roller 4*a*, a nonmagnetic one-component toner 5*a*, and a developer applying blade 7*a*. The photosensitive drum 1*a*, the charging roller 2*a*, the cleaning unit 3*a*, and the developing unit 8*a* form an integral process cartridge 9*a* which is removably mounted to the image forming apparatus 170.

An exposure device 11*a* serving as an exposing unit includes a scanner unit configured to scan laser light by a polygon mirror, or a light emitting diode (LED) array. The exposure device 11*a* radiates a scanning beam 12*a* modulated based on an image signal onto the photosensitive drum 1*a*. Further, the charging roller 2*a* is connected to a charging high-voltage power source 20*a* serving as a voltage supply unit for the charging roller 2*a*. The developing roller 4*a* is connected to a development high-voltage power source 21*a* serving as a voltage supply unit for the developing roller 4*a*. A primary transfer roller 10*a* is connected to a primary transfer high-voltage power source 22*a* serving as a voltage supply unit for the primary transfer roller 10*a*. The configuration of the first station has been described above, and the second, third, and fourth stations also have similar configurations. As for the other stations, components having same functions as those of the first station are denoted by same reference numerals, and the reference numerals are provided with suffixes "b", "c", and "d" for the respective stations. In the following description, the suffixes "a", "b", "c", and "d" are omitted except for a case in which a specific station is described.

An intermediate transfer belt 13 is supported by three rollers of a secondary transfer opposing roller 15, a tension roller 14, and an auxiliary roller 19 serving as stretching members for the intermediate transfer belt 13. Only the tension roller 14 is applied with a force by a spring in a direction of stretching the intermediate transfer belt 13, and thus an appropriate tension force is maintained with respect to the intermediate transfer belt 13. The secondary transfer opposing roller 15 follows the drive of a main motor (not shown) to rotate, and thus the intermediate transfer belt 13 wound around an outer periphery of the secondary transfer opposing roller 15 is rotated. The intermediate transfer belt 13 is moved at a substantially same speed in a forward direction (for example, clockwise direction of FIG. 1) with respect to the photosensitive drums 1*a* to 1*d* (for example, rotation in the counterclockwise direction of FIG. 1). Further, the intermediate transfer belt 13 is rotated in the arrow direction (clockwise direction), and the primary transfer roller 10 is arranged on the opposite side of the photosensitive drum 1 across the intermediate transfer belt 13 so as to rotate in association with the movement of the intermediate transfer belt 13. A position at which the photosensitive drum 1 and the primary transfer roller 10 are brought into abutment against each other across the intermediate transfer belt 13 is referred to as "primary transfer position." The auxiliary roller 19, the tension roller 14, and the secondary transfer opposing roller 15 are electrically grounded. The second to fourth stations have primary transfer rollers 10*b* to 10*d* configured similarly to the primary transfer roller 10*a* of the first station, and hence description thereof is omitted here.

Next, an image forming operation of the image forming apparatus 170 according to Embodiment 1 is described. When the image forming apparatus 170 receives a printing instruction under a standby state, the image forming apparatus 170 starts the image forming operation. The photosensitive drum 1, the intermediate transfer belt 13, and the like start rotation in the arrow direction at a predetermined process speed by the main motor (not shown). The photosensitive drum 1*a* is uniformly charged by the charging roller 2*a* applied with a voltage by the charging high-voltage power source 20*a*, and subsequently an electrostatic latent image is formed in accordance with image information (also referred to as "image data") by the scanning beam 12*a* radiated from the exposure device 11*a*. The toner 5*a* in the developing unit 8*a* is negatively charged to be applied on the developing roller 4*a* by the developer applying blade 7*a*. Then, the developing roller 4*a* is supplied with a predetermined developing voltage by the development high-voltage power source 21*a*. When the photosensitive drum 1*a* is rotated so that the electrostatic latent image formed on the photosensitive drum 1*a* arrives at the developing roller 4*a*, the negative toner adheres on the electrostatic latent image so as to be visible, and a toner image of a first color (for example, yellow (Y)) is formed on the photosensitive drum 1*a*. The stations of the other colors of magenta (M), cyan (C), and black (K) (process cartridges 9*b* to 9*d*) also operate similarly. A write signal from a controller (not shown) is delayed at a constant timing depending on distances between the primary transfer positions of the respective colors so that electrostatic latent images are formed by exposure on the photosensitive drums 1*a* to 1*d*. The primary transfer rollers 10*a* to 10*d* are each applied with a DC high voltage having a polarity opposite to that of toner. With the above-mentioned steps, toner images are sequentially transferred onto the intermediate transfer belt 13 (hereinafter referred to as "primary transfer"), and thus multi-layered toner images are formed on the intermediate transfer belt 13.

After that, in synchronization with the formation of the toner images, sheets P corresponding to recording materials stacked on a cassette 16 are conveyed along a conveyance path Y. Specifically, the sheet P is fed (picked up) by a sheet feeding roller 17 driven to rotate by a sheet feeding solenoid (not shown). The fed sheet P is conveyed to registration rollers 18 by conveyance rollers. Then, the sheet P passes through a sheet width sensor 112 serving as a detecting unit configured to detect a length of the sheet in a direction orthogonal to a conveyance direction CD (FIG. 3B) (hereinafter referred to as "width"). A registration sensor 113 is arranged on the downstream of the registration rollers 18. The registration sensor 113 detects the "presence" of the sheet P when a leading edge of the sheet P arrives, and detects the "absence" of the sheet P when a trailing edge of the sheet P passes through the registration sensor 113.

The sheet P is conveyed by the registration rollers 18 to a transfer nip portion being an abutment portion between the intermediate transfer belt 13 and a secondary transfer roller 25 in synchronization with the toner images formed on the intermediate transfer belt 13. The secondary transfer roller 25 is applied with a voltage having a polarity opposite to that of the toner by a secondary transfer high-voltage power source 26. Thus, the multi-layered toner images of the four colors borne on the intermediate transfer belt 13 are collectively transferred onto the sheet P (recording material) (hereinafter referred to as "secondary transfer"). Members contributing to the process until the unfixed toner images are formed on the sheet P (for example, the photosensitive drum 1) function as an image forming unit. Meanwhile, after the secondary transfer is finished, toner remaining on the intermediate transfer belt 13 is removed by the cleaning unit 27. The sheet P that has been subjected to the secondary transfer is conveyed to a fixing apparatus 50 serving as a fixing unit, to thereby be subjected to fixing of the toner images. Then, the sheet P is discharged to a discharge tray 30 as an image-formed object (print or copy). A film 51, a nip forming member 52, a pressure roller 53, and a heater 54 of the fixing apparatus 50 are described later.

A printing mode of printing images continuously on a plurality of sheets P is hereinafter referred to as "continuous printing" or "continuous job." In the continuous printing, an interval between a trailing edge of a sheet P on which printing is first performed (hereinafter referred to as "preceding sheet") and a leading edge of a succeeding sheet P on which printing is performed subsequent to the preceding sheet (hereinafter referred to as "succeeding sheet") is referred to as "sheet interval." The image forming apparatus 170 according to the first embodiment is a center-reference image forming apparatus 170 configured to perform a printing operation while causing central positions of each member and the sheet P in the direction orthogonal to the conveyance direction CD (longitudinal direction to be described later) to match each other. Thus, even in a printing operation of a sheet P having a large length in the direction orthogonal to the conveyance direction CD or a printing operation of a sheet P having a small length in the direction orthogonal to the conveyance direction CD, the central positions of the sheets P match each other. The center reference is adopted as the conveyance reference, but an end-portion reference or other references may be adopted.

[Block Diagram of Image Forming Apparatus]

Figure 2:
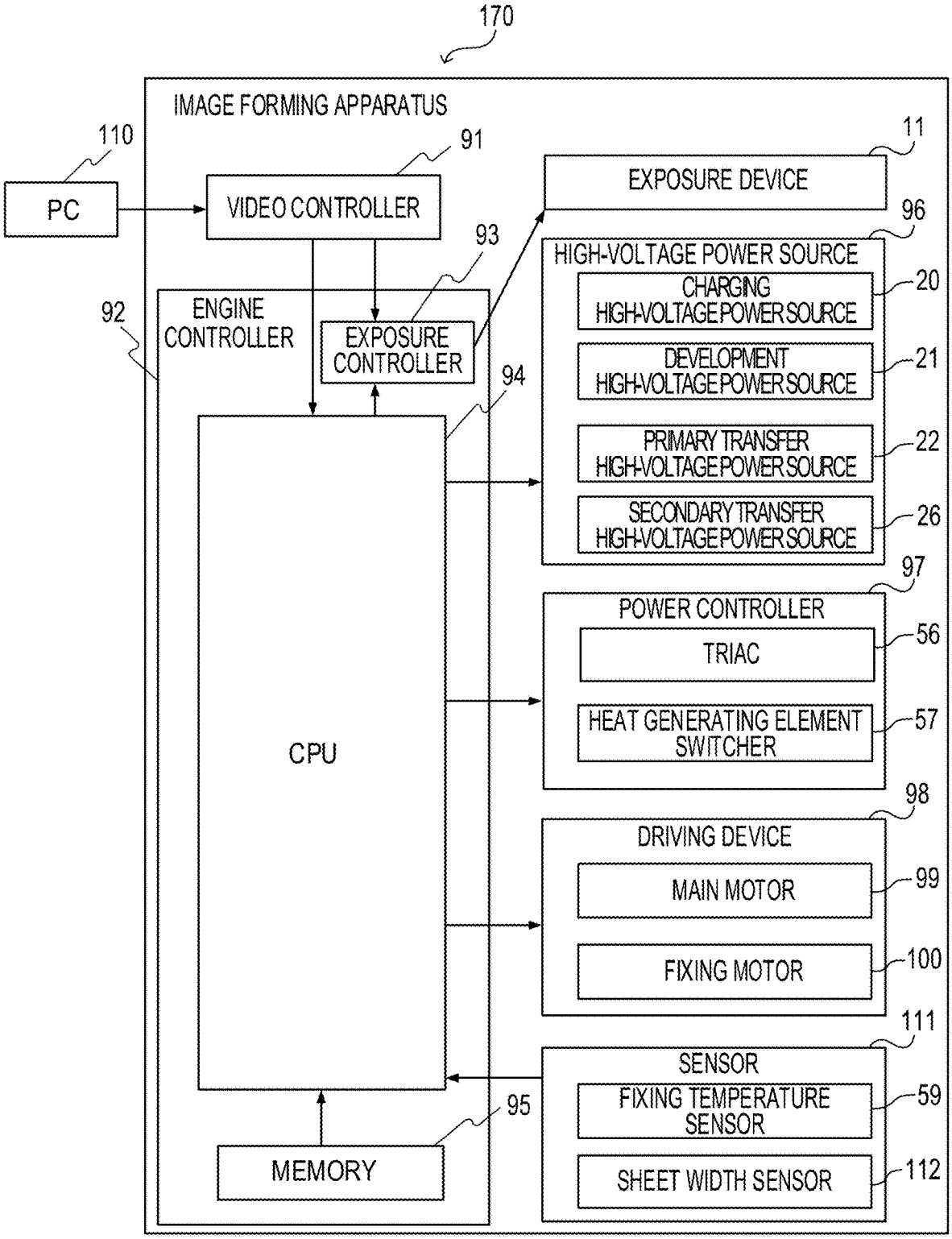
FIG. 2 is a control block diagram of the image forming apparatus according to each of the first embodiment, the second embodiment, the third embodiment, the fourth embodiment, and the fifth embodiment.

FIG. 2 is a block diagram for illustrating the operation of the image forming apparatus 170. With reference to FIG. 2, the printing operation of the image forming apparatus 170 is described. A PC 110 serving as a host computer plays a role of outputting a printing instruction to a video controller 91 provided inside the image forming apparatus 170 and transferring image data of a printing image to the video controller 91.

The video controller 91 converts the image data input from the PC 110 into exposure data, and transfers the exposure data to an exposure controller 93 provided inside an engine controller 92. The exposure controller 93 is controlled by a CPU 94 to turn on and off the exposure data and control the exposure device 11. The size of the exposure data is determined based on an image size. When the CPU 94 serving as a control unit receives the printing instruction, the CPU 94 starts an image forming sequence.

The engine controller 92 includes the CPU 94, a memory 95, and the like to perform an operation programmed in advance. A high-voltage power source 96 includes the above-mentioned charging high-voltage power source 20, development high-voltage power source 21, primary transfer high-voltage power source 22, and secondary transfer high-voltage power source 26. Further, a power controller 97 includes a bidirectional thyristor (hereinafter referred to as "triac") 56. The power controller 97 further includes, for example, a heat generating element switcher 57 serving as a switching unit configured to switch power supply paths for supplying electric power to switch a plurality of heat generating elements having different lengths in the longitudinal direction described in the fifth embodiment. The power controller 97 determines an amount of electric power to be supplied. Further, in the fixing apparatus 50 according to the fifth embodiment, the power controller 97 selects the heat generating element that generates heat. The heat generating element switcher 57 is, for example, a relay.

Further, a driving device 98 includes, for example, a main motor 99 and a fixing motor 100. Further, a sensor 111 includes, for example, a fixing temperature sensor 59 configured to detect a temperature of the fixing apparatus 50, and the sheet width sensor 112 configured to detect the width of the sheet P. A detection result of the sensor 111 is transmitted to the CPU 94. The registration sensor 113 is also included in the sensor 111. The CPU 94 acquires the detection result of the sensor 111 included in the image forming apparatus 170 to control the exposure device 11, the high-voltage power source 96, the power controller 97, and the driving device 98. In this manner, the CPU 94 controls an image forming step of performing, for example, formation of the electrostatic latent images, transfer of the developed toner images, and fixing of the toner images to the sheet P, to thereby print the exposure data as toner images on the sheet P. The image forming apparatus 170 to which the present invention is applied is not limited to the image forming apparatus 170 having the configuration described with reference to FIG. 1, and is only required to be an image forming apparatus 170 which is capable of performing printing on sheets P having different widths, and includes the fixing apparatus 50 including the heater to be described later.

[Fixing Apparatus]

Figure 3A:
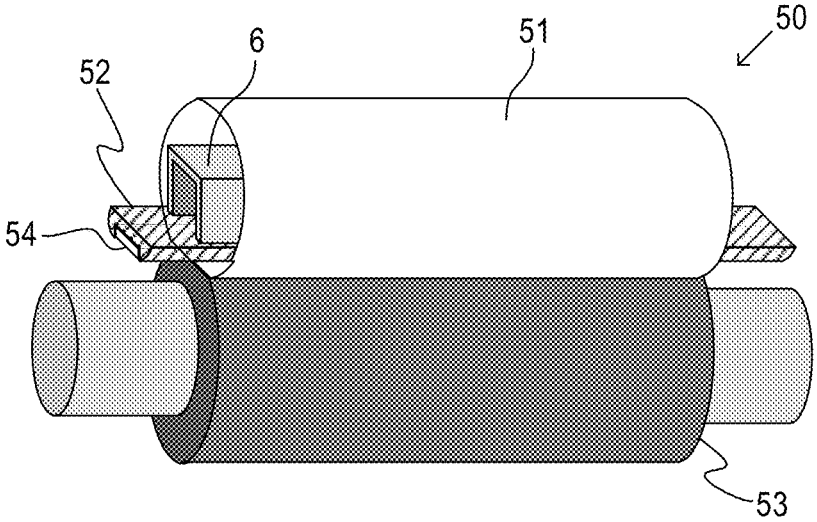
FIG. 3A is a perspective view for illustrating a configuration of a fixing apparatus according to the first embodiment.
Figure 3B:
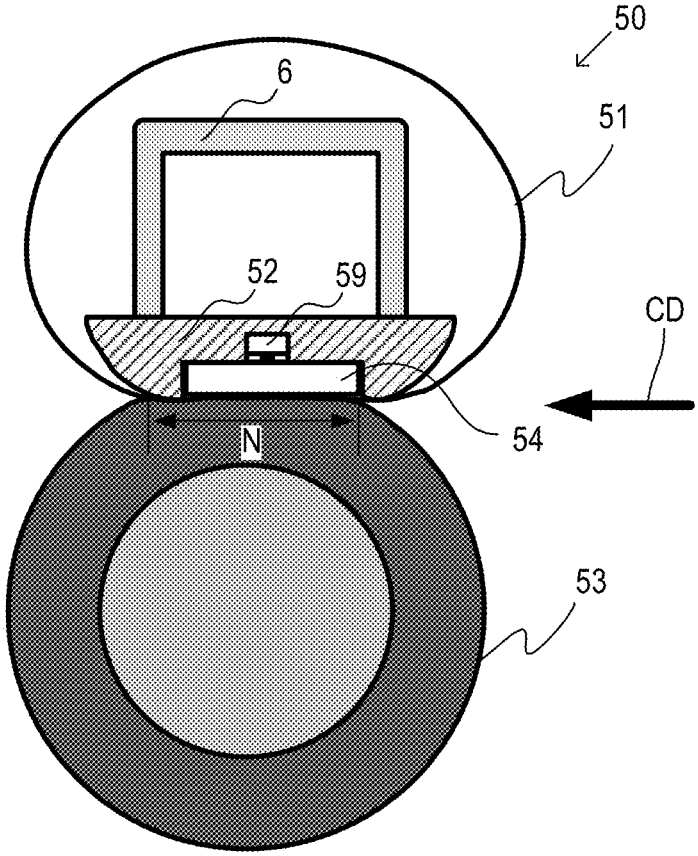
FIG. 3B is a sectional view for illustrating the configuration of the fixing apparatus according to the first embodiment.

FIG. 3A is a perspective view of a main part in the longitudinal direction of the fixing apparatus 50 according to the first embodiment. FIG. 3B is a sectional view of the fixing apparatus 50 at a central position in the longitudinal direction. The fixing apparatus 50 includes the cylindrical film 51 serving as a first rotary member, and the pressure roller 53 serving as a second rotary member configured to form a fixing nip portion (nip portion) together with the film 51. The fixing apparatus 50 further includes the heater 54 serving as a heating member, the nip forming member 52 configured to hold the heater 54, and a stay 6 configured to keep the strength in the longitudinal direction.

The film 51 is formed of, for example, a polyimide base material, a silicone rubber layer, and a PFA mold release layer. The polyimide base material has a film thickness of 50 μm. The silicone rubber layer has a film thickness of 200 μm and is formed on the polyimide base material. The PFA mold release layer has a film thickness of 20 μm and is formed on the silicone rubber layer. The pressure roller 53 is formed of, for example, an SUM metal core, a silicone rubber elastic layer, and a PFA mold release layer. The SUM metal core has an outer diameter of 13 mm. The silicone rubber elastic layer has a film thickness of 3.5 mm and is formed on the SUM metal core. The PFA mold release layer has a film thickness of 40 μm and is formed on the silicone rubber elastic layer. The pressure roller 53 is rotated by a drive source (not shown), and the film 51 follows the drive of the pressure roller 53 to rotate. The heater 54 is held by the nip forming member 52, and an inner circumferential surface (inner surface) of the film 51 and a surface of the heater 54 are in contact with each other. Both ends of the stay 6 are pressurized by a pressurizing unit (not shown), and the pressurizing force is received by the pressure roller 53 via the nip forming member 52 and the film 51. As a result, a fixing nip portion N at which the film 51 and the pressure roller 53 are in pressure contact with each other is formed. The nip forming member 52 is required to have stiffness, a heat resistance, and a heat insulating property, and is formed of a liquid crystal polymer.

The heater 54 serving as the heating member has, on its back surface at its central portion in the longitudinal direction, the fixing temperature sensor 59 serving as a temperature detecting unit and a thermoswitch (not shown) serving as a safety element which are arranged in contact with each other. The fixing temperature sensor 59 is a chip resistance-type thermistor. A chip resistance of the fixing temperature sensor 59 is detected, and a detection result is used for temperature control of the heater 54. The fixing temperature sensor 59 can also detect an excessive increase in temperature (hereinafter referred to as "excessive temperature rise"). A thermistor (not shown) is arranged on each of both end portions of the fixing temperature sensor 59 in the longitudinal direction, and those thermistors monitor the temperature of the back surface of the heater 54 at the end portions in the longitudinal direction. The thermoswitch (not shown) is a bimetal thermoswitch, and the heater 54 and the thermoswitch are electrically connected to each other. When the thermoswitch detects the excessive temperature rise on the back surface of the heater 54, a bimetal inside the thermoswitch operates, thereby being capable of interrupting electric power to be supplied to the heater 54.

[Heater]

Figure 4A:
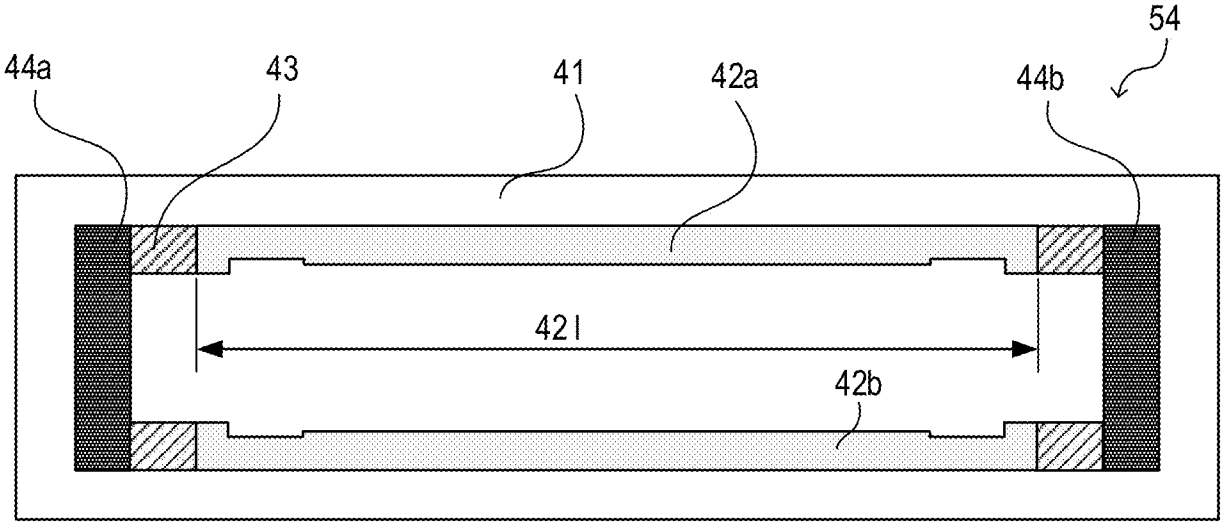
FIG. 4A, FIG. 4B and FIG. 4C are a plan view, a side view, and a sectional view, respectively, for illustrating a configuration of a heater in the first embodiment.
Figure 4B:
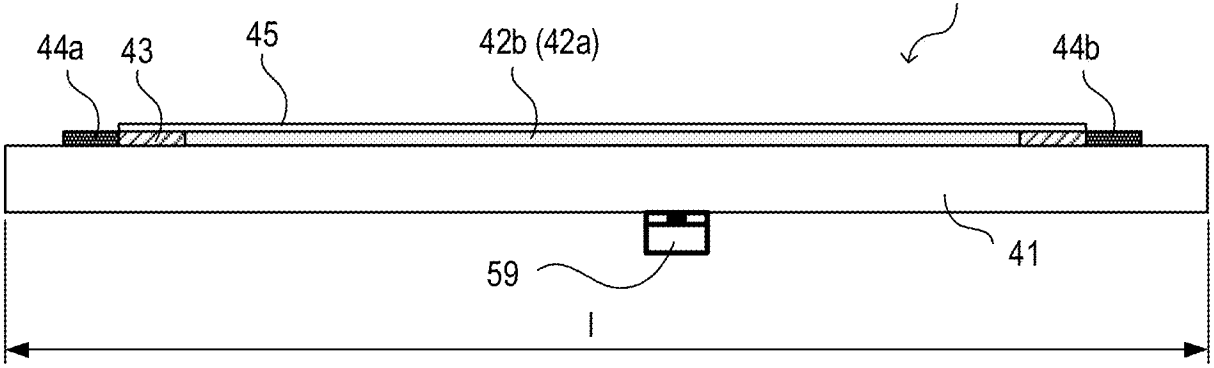
Figure 4C:
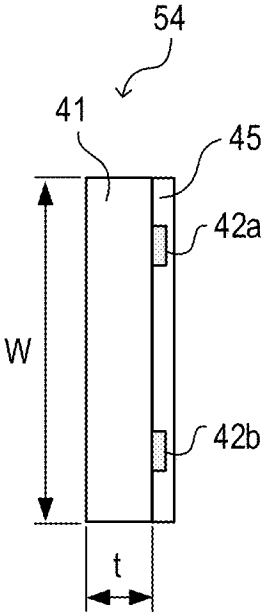

FIG. 4A, FIG. 4B, and FIG. 4C are a plan view, a side view, and a sectional view, respectively, in the longitudinal direction of the heater 54 in the first embodiment. The heater 54 has a basic configuration in which, on a ceramic substrate (hereinafter referred to as "substrate") 41, heat generating elements 42*a* and 42*b*, conductive paths 43, and contacts 44*a* and 44*b* are formed. The ceramic substrate 41 is, for example, a plate-shaped substrate made of alumina. The heat generating elements 42*a* and 42*b* are, for example, heat generating elements containing silver and palladium as main components. The conductive paths 43 have electric resistance values lower than those of the heat generating elements 42*a* and 42*b*. The contacts 44*a* and 44*b* are provided for supplying electric power to the heat generating elements 42*a* and 42*b*. An area other than the contacts 44*a* and 44*b* is coated with an insulating glass 45. When a voltage is applied between the contact 44*a* and the contact 44*b*, the heat generating elements 42*a* and 42*b* on the substrate 41 generate heat.

The substrate 41 has dimensions of, for example, a thickness "t"=1 mm, a width W=7.0 mm, and a length "l"=280 mm. The heat generating elements 42*a* and 42*b* having the same dimension in a length 421 (=222 mm) in the longitudinal direction are arranged side by side in a widthwise direction of the substrate 41. On the substrate 41, components are arranged in the longitudinal direction in order of the contact 44*a*, the conductive path 43, the heat generating element 42*a*, the conductive path 43, and the contact 44*b* to be electrically connected in series to each other. The heat generating element 42*b* is also similarly connected on the substrate 41. The heat generating element 42*a* has an electric resistance in the longitudinal direction of 21Ω, and the heat generating element 42*b* also has the same electric resistance of 21Ω. The heat generating elements 42*a* and 42*b* are connected in parallel to each other, and hence the two heat generating elements 42*a* and 42*b* have a combined electric resistance value of 10.5Ω. The heat generating elements 42*a* and 42*b* and the conductive paths 43 are covered with the glass 45 to maintain an insulating property. The fixing temperature sensor 59 configured to detect the temperature of the back side of the heater 54 is arranged at a substantially central portion in the longitudinal direction. The voltage to be input to the heat generating elements 42*a* and 42*b* is controlled based on the detection result of the fixing temperature sensor 59.

[Configuration of Heater End Portion]

Figure 5A:
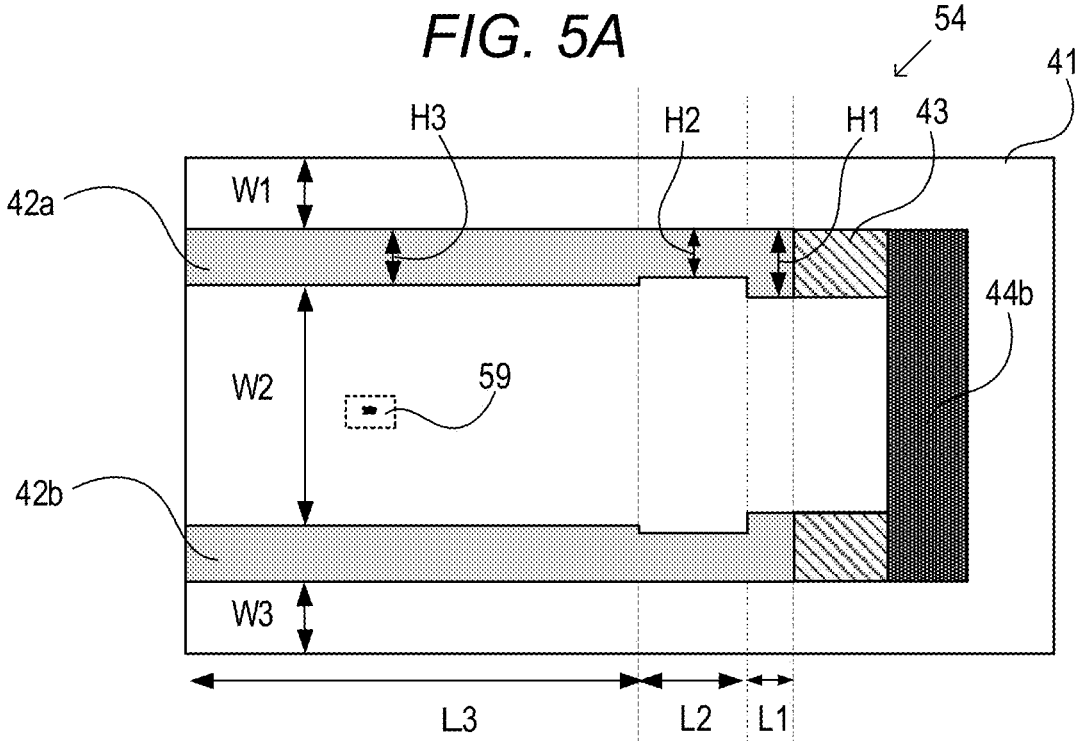
FIG. 5A, FIG. 5B, FIG. 5C and FIG. 5D are views for illustrating a positional relationship between the heater and each of sheets in the first embodiment.

FIG. 5A is an enlarged view of a main part of the right half of the heater 54, in which a central portion side in the longitudinal direction of the heat generating elements 42*a* and 42*b* in the first embodiment is illustrated at a left end. The heat generating elements 42*a* and 42*b* each have a bilaterally symmetrical shape, and hence description of the left half is omitted here. Now, the dimensions of the heat generating element 42*a* are described. The heat generating element 42*a* has lengths in the widthwise direction (hereinafter referred to as "widths") of H1=1.0 mm, H2=0.7 mm, and H3=0.8 mm That is, the heat generating element 42*a* is shaped to have three different widths in the widthwise direction satisfying "H1>H3>H2."

Figure 5B:
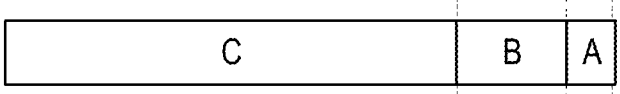

Further, the heat generating element 42*a* has, in a part having the width H1 corresponding to a first width, a first length in the longitudinal direction of L1=6 mm. Further, the heat generating element 42*a* has, in a part having the width H2 corresponding to a second width, a second length in the longitudinal direction of L2=22 mm. Further, the heat generating element 42*a* has, in a part having the width H3 corresponding to a third width, a third length in the longitudinal direction of L3=83 mm. That is, the heat generating element 42*a* is shaped to have three different lengths in the longitudinal direction satisfying "L3>L2>L1" in the parts having the respective widths. The heat generating element 42*b* is shaped to be vertically symmetrical (symmetrical with respect to a virtual central line in the widthwise direction) to the heat generating element 42*a*, and hence has the same dimensions as those of the heat generating element 42*a*. A distance W1 between the heat generating element 42*a* and one end portion of the substrate 41, and a distance W3 between the heat generating element 42*b* and another end portion of the substrate 41 are 1.0 mm, and a distance W2 between the heat generating element 42*a* and the heat generating element 42*b* is 3.4 mm. As illustrated in FIG. 5B, in each of the heat generating elements 42*a* and 42*b*, an area having the width H1 in the widthwise direction is referred to as "area A", an area having the width H2 is referred to as "area B," and an area having the width H3 is referred to as "area C."

The reason why the heat generating elements 42*a* and 42*b* are formed into the above-mentioned shape is because it is desired that, when a voltage is applied to the heat generating elements 42*a* and 42*b*, a heat generation amount per unit length (energy density P) be larger in order of the area B, the area C, and the area A. When the energy densities of the areas A, B, and C are represented by P1, P2, and P3, respectively, a relationship of "P2>P3>P1" is satisfied. That is, the heat generating elements 42*a* and 42*b* each have the area A corresponding to a first area being located on an end portion side in an orthogonal direction orthogonal to the conveyance direction CD of the sheet P and having the energy density P1 corresponding to a first heat generation amount as a heat generation amount per unit length. Further, the heat generating elements 42*a* and 42*b* each have the area B corresponding to a second area being located on an inner side of the first area and having the energy density P2 corresponding to a second heat generation amount as the heat generation amount per unit length. Further, the heat generating elements 42*a* and 42*b* each have the area C corresponding to a third area being located on the inner side of the second area and having the energy density P3 corresponding to a third heat generation amount as the heat generation amount per unit length.

The heat generating elements 42*a* and 42*b* in the first embodiment each have the largest width H1 in the area A, the smallest width H2 in the area B, and the intermediate width H3 between the width H1 of the area A and the width H2 of the area B in the area C. That is, "H1>H3>H2" is satisfied. In this manner, the area A being an area on the outermost side (hereinafter referred to as "outermost area") among the area A, the area B, and the area C has the smallest electric resistance value R1 corresponding to a first electric resistance value per unit length. Further, the area B adjacent to the outermost area has the largest electric resistance value R2 corresponding to a second electric resistance value, and the area C located at a central portion in the longitudinal direction has an intermediate electric resistance value R3 corresponding to a third electric resistance value. In this manner, the electric resistance value per unit length can be set to be larger in order of the area B, the area C, and the area A. That is, "R2>R3>R1" is satisfied. In this manner, when a voltage is applied to the heat generating elements 42*a* and 42*b*, the heat generation amount per unit length (energy density P) can be set to be larger in order of the area B, the area C, and the area A.

Figure 5C:
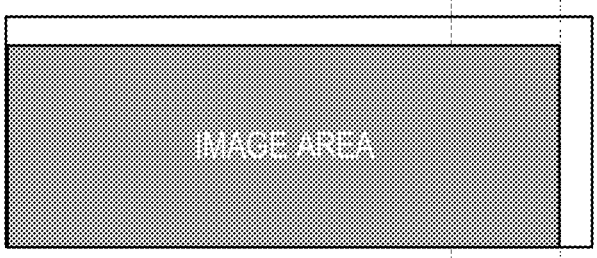
Figure 5D:
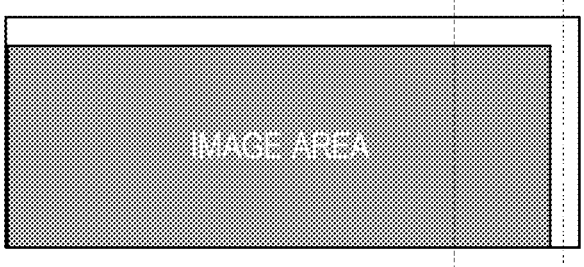

FIG. 5C is a view for illustrating an LTR sheet corresponding to a first sheet having a largest length in the longitudinal direction (hereinafter referred to as "sheet width"). FIG. 5D is a view for illustrating an A4 sheet corresponding to a second sheet having the second largest sheet width after the first sheet. A positional relationship between the sheet P and the heat generating elements 42*a* and 42*b* is described. In this case, the first sheet is the largest sheet among the sheets that are allowed to be subjected to fixing processing by the fixing apparatus 50. A leading end of the sheet and a right end of the sheet both have a margin of 5 mm, and an area of an image other than the margin is defined as an image area. A trailing end of the sheet and a left end of the sheet are not shown, but both of the ends have a margin of 5 mm. In the longitudinal direction, an end portion of the A4 sheet is included in the area A. Meanwhile, in the case of the LTR sheet, an end portion of the image area is included in the area B. The A4 sheet has a sheet width smaller than that of the LTR sheet, and hence has a larger non-sheet passing portion area. That is, the A4 sheet is more liable to be excessively increased in temperature at the non-sheet passing portion as compared to the LTR sheet. In the first embodiment, the heat generating elements 42*a* and 42*b* are formed into the above-mentioned shape, and hence the end portion of the A4 sheet is included in the area A having a low energy density P (energy density P1). In this manner, even when the fixing processing is performed on the A4 sheet, the heat generation amount at the non-sheet passing portion can be reduced. That is, the excessive temperature rise at the non-sheet passing portion can be suppressed.

Next, members such as the film 51 and the pressure roller 53 are generally longer than the heat generating elements 42*a* and 42*b*, and hence the end portion of each of the members in the longitudinal direction is more liable to drop in temperature as compared to the central portion thereof, and tends to be reduced in fixability of toner to the sheet P. The temperature tends to become lower as a part of the film 51 or the pressure roller 53 approaches the end portion thereof. The fixing processing on the LTR sheet having the largest sheet width causes the largest degree of end temperature sagging (hereinafter referred to as "end temperature sagging amount"). In the first embodiment, the end portion of the image area of the LTR sheet is included in the area B having a high energy density P (energy density P2), thereby being capable of reducing the end temperature sagging of each member in the vicinity of the end portion of the image area of the LTR sheet when the LTR sheet is conveyed.

As described above, in an area from the end portion to the central portion of each of the heat generating elements 42*a* and 42*b* in the longitudinal direction, each of the heat generating elements 42*a* and 42*b* is sectioned into the first area, the second area, and the third area in order from the end portion. Further, the widths of each of the heat generating elements 42*a* and 42*b* in the widthwise direction corresponding to those areas are set to be smaller in order of the second width, the third width, and the first width. Therefore, the electric resistance value per unit length of each of the heat generating elements 42*a* and 42*b* is set to be larger in order of the second electric resistance value, the third electric resistance value, and the first electric resistance value, and thus the heat generation amount per unit length (energy density) is set to be larger in order of the second heat generation amount, the third heat generation amount, and the first heat generation amount. In this manner, the end portion of the image area of the first sheet having the largest sheet width can be included in the second area, and the end portion of the second sheet having the second largest sheet width after the first sheet can be included in the first area. When the heat generating elements 42*a* and 42*b* are formed into such a shape, the end temperature sagging of each member of the fixing apparatus 50 to be caused when the first sheet having the largest sheet width is conveyed can be suppressed, and the excessive temperature rise at the non-sheet passing portion to be caused when the second sheet having the second largest sheet width after the first sheet is conveyed can be suppressed. That is, those two effects can be both achieved.

Embodiment and Comparative Example

In order to verify the effects of the first embodiment, Comparative Example 1 in which the heat generating elements 42*a* and 42*b* are shaped different is used to verify: (i) the temperature drop amount at the end portion of each of the heat generating elements 42*a* and 42*b* in the longitudinal direction; and (ii) the temperature rise amount at the non-sheet passing portion when the A4 sheets are continuously subjected to fixing processing.

Comparative Example 1

Figure 6C:
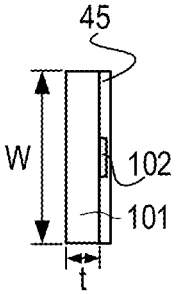
FIG. 6A, FIG. 6B, FIG. 6C, FIG. 6D, FIG. 6E, FIG. 6F and FIG. 6G are views for illustrating Comparative Example for comparison with the first embodiment.
Figure 6A:
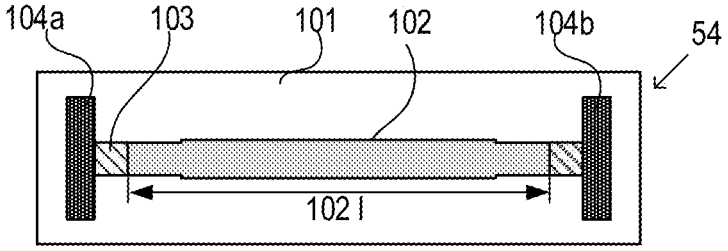
Figure 6B:
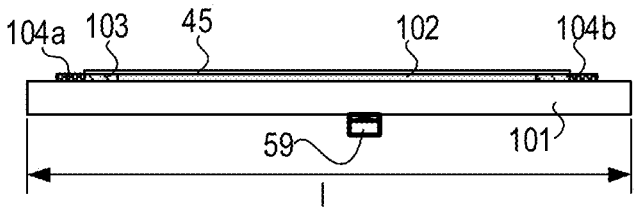

FIG. 6A, FIG. 6B, and FIG. 6C are a plan view, a side view, and a sectional view, respectively, in the longitudinal direction of the heater 54 in Comparative Example 1. A substrate 101 has dimensions of a thickness "t"=1 mm, a width W=7.0 mm, and a length "l"=280 mm. A heat generating element 102 having a length 102*l*=222 mm is arranged in the longitudinal direction, and end portions of the heat generating element 102 are electrically connected to conductive paths 103 and contacts 104*a* and 104*b* for supplying electric power. The heat generating element 102 has an electric resistance value in the longitudinal direction of 10.5Ω. The heat generating element 102 has a bilaterally-symmetrical dimensional shape with respect to a central portion of the substrate 101 in the longitudinal direction. Further, the heat generating element 102 and the conductive paths 103 are covered with the glass 45 to maintain the insulating property. The fixing temperature sensor 59 configured to detect the temperature of the back surface of the heater 54 is arranged at a substantially central portion in the longitudinal direction. The voltage to be input to the heat generating element 102 is controlled based on the detection result of the fixing temperature sensor 59.

Figure 6D:
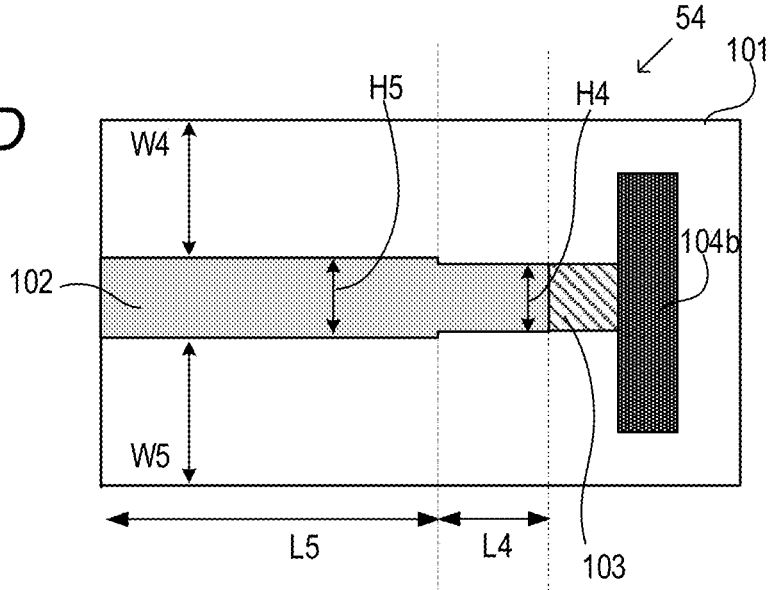

FIG. 6D is an enlarged view of the right half of the heater 54, in which a central portion in the longitudinal direction of the heat generating element 102 in Comparative Example 1 is illustrated at a left end. The heat generating element 102 has a bilaterally symmetrical shape in the longitudinal direction, and hence description of the left half is omitted here. The heat generating element 102 in Comparative Example 1 has different widths in the widthwise direction of the heat generating element 102 between the end portion in the longitudinal direction and the central portion in the longitudinal direction. The heat generating element 102 has widths in the widthwise direction of H4=1.46 mm and H5=1.6 mm, and "H5>H4" is satisfied. The heat generating element 102 has, in a part having the width H4, a length in the longitudinal direction of L4=28 mm, and, in a part having the width H5, a length in the longitudinal direction of L5=83 mm A distance W4 between the heat generating element 102 and one end portion of the substrate 101 in the widthwise direction, and a distance W5 between the heat generating element 102 and another end portion of the substrate 101 in the widthwise direction are both 5.4 mm.

Figure 6E:
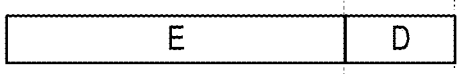

As illustrated in FIG. 6E, in the heat generating element 102, an area having the width H4 is referred to as "area D," and an area having the width H5 is referred to as "area E." The area D has the smallest width in the widthwise direction of the heat generating element 102, and the area E has the largest width in the widthwise direction of the heat generating element 102. In the heat generating element 102, in the longitudinal direction, the area D is larger than the area E in electric resistance value per unit length and also in energy density.

Figure 6F:
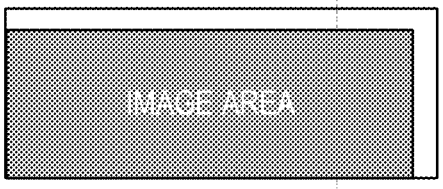
Figure 6G:
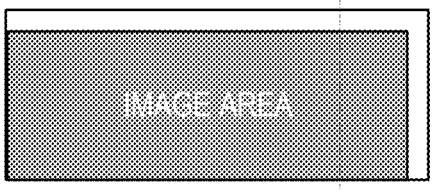

FIG. 6F is a view for illustrating an LTR sheet corresponding to the first sheet having the largest sheet width. FIG. 6G is a view for illustrating an A4 sheet corresponding to the second sheet having the second largest sheet width after the first sheet. A positional relationship between the sheet P and the heat generating element 102 is described. A leading end of the sheet and a right end of the sheet both have a margin of 5 mm, and an area other than the margin is defined as an image area. A trailing end of the sheet and a left end of the sheet are not shown, but both of the ends have a margin of 5 mm. In Comparative Example, the end portion of the LTR sheet, the end portion of the image area of the LTR sheet, the end portion of the A4 sheet, and the end portion of the image area of the A4 sheet are all included in the area D having a large electric resistance value per unit length.

(i) Temperature Drop Amount at End Portion in Longitudinal Direction (End Temperature Sagging)

Figure 7A:
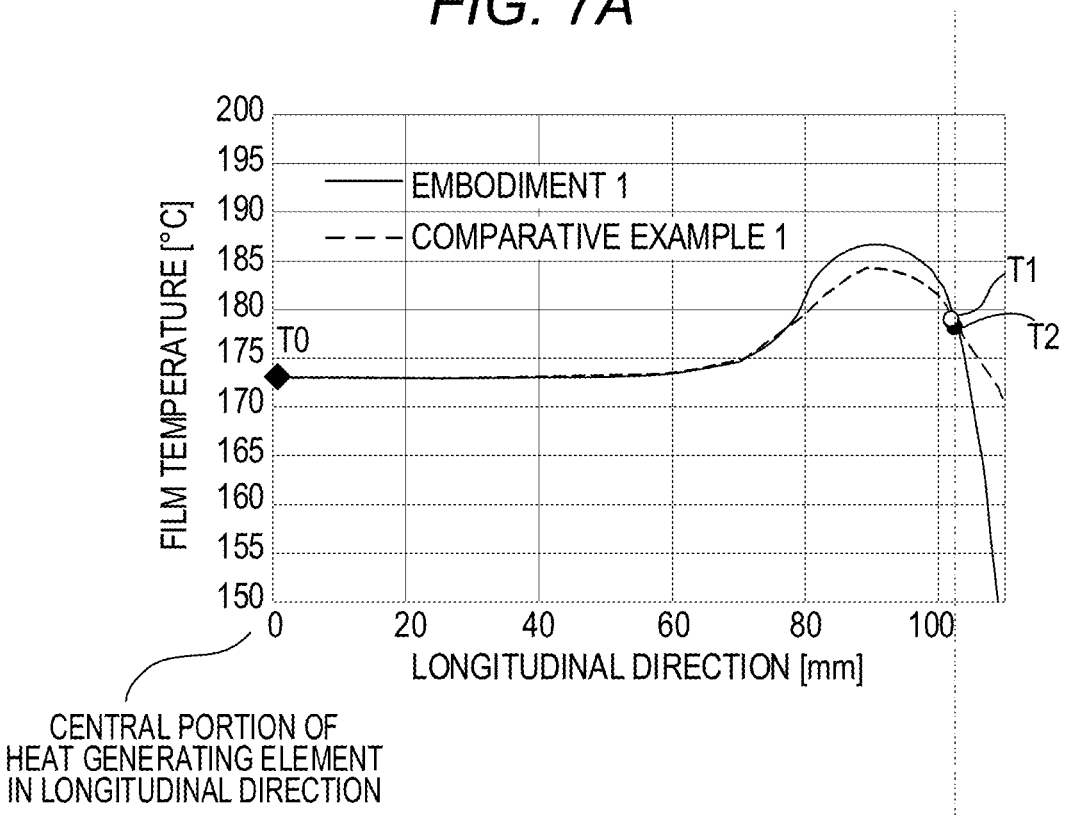
FIG. 7A is a graph for showing a film temperature in the first embodiment.
Figure 7B:
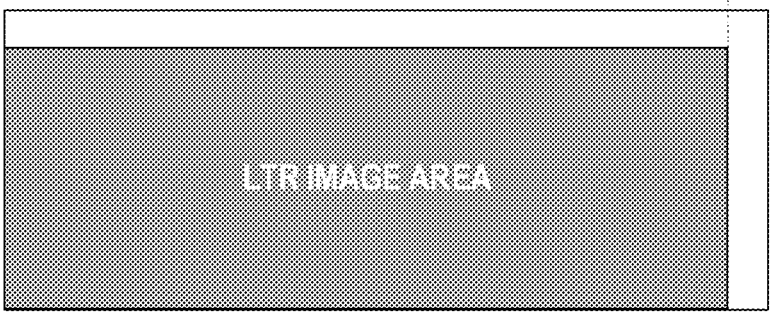
FIG. 7B is a view for illustrating positions of a sheet and an image area.

Temperature profiles of the film 51 in the longitudinal direction, which were obtained when the heaters 54 in the first embodiment and Comparative Example 1 were incorporated in the fixing apparatus 50, were verified, and are shown in FIG. 7A. In FIG. 7A, the horizontal axis indicates a position in the longitudinal direction (mm), and the vertical axis indicates a temperature of the film 51 (film temperature) (° C.). Further, FIG. 7B is an illustration of the LTR sheet and the image area corresponding to the position in the longitudinal direction of FIG. 7A. The central portion of each of the heat generating elements 42*a* and 42*b* or the heat generating element 102 in the longitudinal direction is set to 0 (0 mm) in an X-axis direction, and only the temperature of the film 51 corresponding to the right side of each of the heat generating elements 42*a* and 42*b* or the heat generating element 102 is shown. As the test conditions, the pressure roller 53 is driven to rotate at a speed of 3 revolutions per second, and the temperature control is performed with the setting (target temperature) of 190° C. Further, the solid line of the graph indicates the temperature in the first embodiment, and the broken line thereof indicates the temperature in Comparative Example 1.

In Comparative Example 1, a temperature T0 of the film 51 at the central portion in the longitudinal direction was about 173° C., and a temperature T1 of the film 51 at the position of the end portion of the image area of the LTR sheet was about 178° C. The temperature T1 at the end portion of the image area of the LTR sheet was higher than the temperature T0 at the central portion in the longitudinal direction (T1>T0), and thus the end temperature sagging was able to be solved even in Comparative Example 1.

Further, in the first embodiment, the temperature T0 of the film 51 at the central portion in the longitudinal direction was about 173° C., and a temperature T2 of the film 51 at the position of the end portion of the image area of the LTR sheet was about 178° C. The temperature T2 at the end portion of the image area of the LTR sheet was higher than the temperature T0 at the central portion in the longitudinal direction (T2>T0), and thus the end temperature sagging was able to be solved. In the graph of FIG. 7A, circle marks are drawn to be shifted so that T1 and T2 can be distinguished from each other. As described above, it was verified that any of Comparative Example 1 and the first embodiment was able to suppress the end temperature sagging within the image area when the first sheet having the largest sheet width was conveyed.

(ii) Temperature Rise at Non-Sheet Passing Portion when A4 Sheets are Continuously Passed The heaters 54 in the first embodiment and Comparative Example 1 were incorporated in the fixing apparatus 50, and one-hundred sheets P were continuously subjected to fixing processing. The temperature profiles in the longitudinal direction of the film 51 obtained after the fixing processing were verified. The center of each of the heat generating elements 42*a* and 42*b* or the heat generating element 102 in the longitudinal direction is set to 0 (0 mm) in the X-axis direction, and only the temperature of the film 51 corresponding to the right side of each of the heat generating elements 42*a* and 42*b* or the heat generating element 102 is shown. As the test conditions, the pressure roller 53 was driven to rotate at a speed of 3 revolutions per second, and the sheets P were input to the fixing apparatus 50 at intervals of one sheet per two seconds. As the sheet P, an A4 sheet of GF-0081 (81.4 g/$m^2$) produced by Canon Inc. was used. The temperature control was performed with the target temperature of the fixing apparatus 50 being set to 210° C.

Figure 8A:
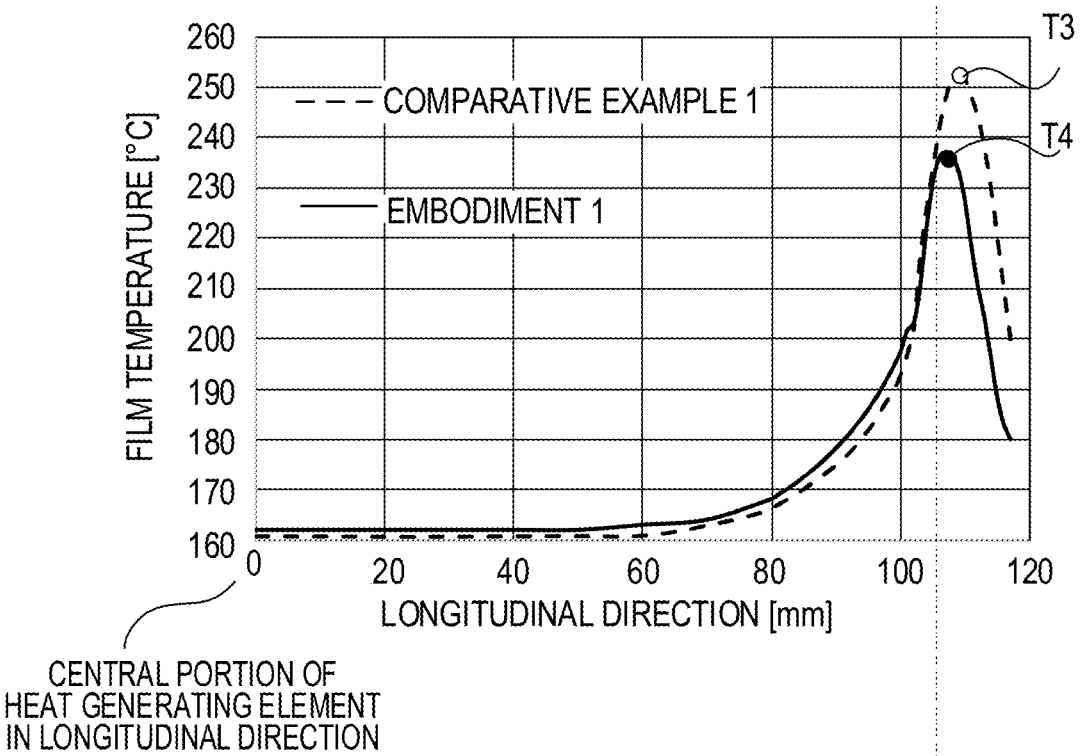
FIG. 8A is a graph for showing a film temperature in the first embodiment.
Figure 8B:
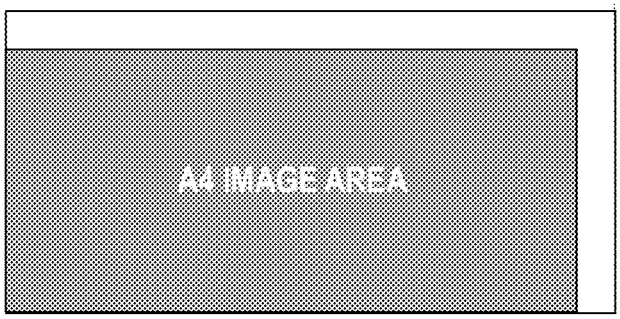
FIG. 8B is a view for illustrating positions of a sheet and an image area.

FIG. 8A shows the test results. The horizontal axis, the vertical axis, the solid line, and the broken line of FIG. 8A are similar to those of FIG. 7A. Further, FIG. 8B is an illustration of the A4 sheet and the image area corresponding to the position in the longitudinal direction of FIG. 8A. In Comparative Example 1, the film temperature reached T3=255° C. at the non-sheet passing area of the A4 sheet. Meanwhile, in the first embodiment, the film temperature reached T4=236° C. at the non-sheet passing area of the A4 sheet. That is, the result of "T3>T4" was obtained. In the case of the heat generating elements 42*a* and 42*b* of the first embodiment, as compared to the case of the heat generating element 102 of Comparative Example 1, the excessive temperature rise was able to be reduced by about 20° C. (=T3−T4=255−236). From the results above, it was verified that the first embodiment was able to suppress the temperature rise at the non-sheet passing portion, but Comparative Example 1 was unable to suppress the temperature rise at the non-sheet passing portion.

As described above, it was able to be verified that, according to the first embodiment, the end temperature sagging of each member caused when the first sheet having the largest sheet width was conveyed and the excessive temperature rise at the non-sheet passing portion caused when the second sheet having the second largest sheet width after the first sheet was conveyed were both able to be suppressed.

When the length in the longitudinal direction of each member such as the film 51 or the pressure roller 53 is larger than the length in the longitudinal direction of the heat generating element, the temperature drop amount of the heat generating element is increased, and hence it is only required that the width in the widthwise direction of the heat generating element in the area B be further decreased to increase the heat generation amount. With reference to FIG. 5A being an enlarged view of the heat generating elements 42*a* and 42*b* in the first embodiment, the boundary between the area A and the area B is set at a substantially same position as the end portion of the image area of the LTR sheet, but the boundary between the area A and the area B may be moved to the outer side in the longitudinal direction to expand the heat generating area having a high energy density. In this case, it is desired to set the boundary between the area A and the area B on the inner side of the end portion of the A4 sheet because the effect of suppressing the temperature rise at the non-sheet passing portion can be maintained.

Even a heat generating area formed on the outer side of the image area of the LTR sheet contributes to the end temperature sagging in the image area of the LTR sheet, and requires a certain energy amount. When it is desired to decrease the length L1 in the longitudinal direction of the area A having a low energy density, the width H1 of each of the heat generating elements 42*a* and 42*b* in the area A may be decreased to slightly increase the energy density in order to contribute to the prevention of the end temperature sagging. Conversely, when it is desired to increase the length L1 in the longitudinal direction of the area A, the energy amount at the non-sheet passing portion area is increased, and hence the width H1 of the area A may be increased to decrease the energy density.

In the first embodiment, the length in the longitudinal direction of each area is smaller in order of the area A, the area B, and the area C (L1<L2<L3). The area A greatly contributes to the temperature rise at the non-sheet passing portion when the A4 sheet is conveyed, and thus is desired to be as narrow as possible. Next, the area B is formed to increase the energy density of each of the heat generating elements 42*a* and 42*b* in order to solve the end temperature sagging. However, the end temperature sagging occurs in an area on the inner side in the longitudinal direction by from 20 mm to 40 mm from the end portion of each of the heat generating elements 42*a* and 42*b* in the longitudinal direction, and hence the length L2 of the area B is desired to be a length of from 20 mm to 40 mm. The area C is an area having the largest length L3 in the longitudinal direction when the area A and the area B are formed into the desired shapes. Thus, the length in the longitudinal direction of each area is desired to be smaller in order of the area A, the area B, and the area C (L1<L2<L3).

As described above, according to the first embodiment, the temperature drop at the end portion in the longitudinal direction of each member of the fixing apparatus and the temperature rise at the non-sheet passing portion can be both suppressed.

Second Embodiment

[Heater]

Figure 9A:
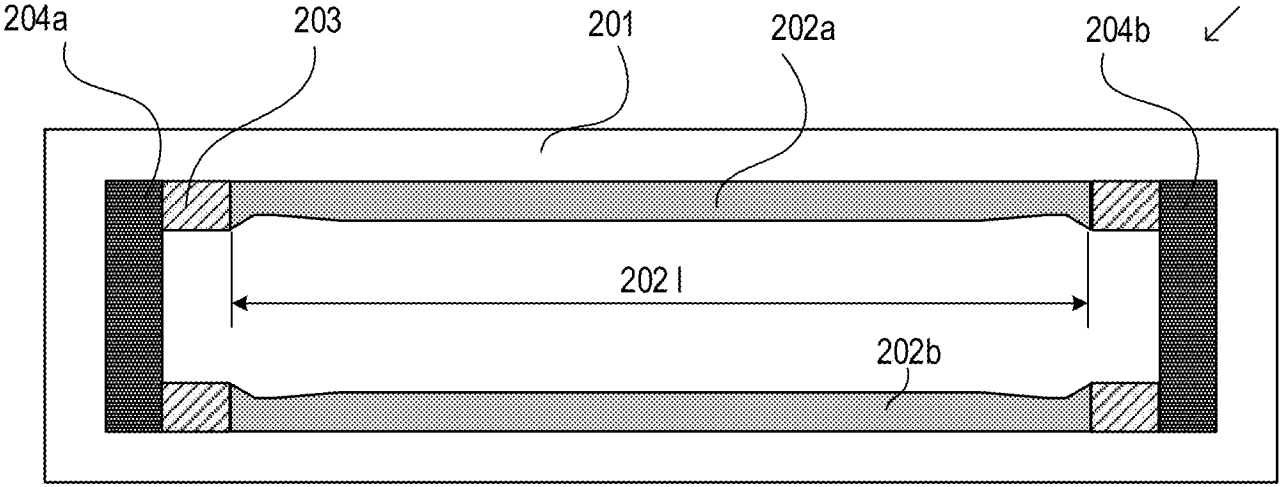
FIG. 9A, FIG. 9B and FIG. 9C are a plan view, a side view, and a sectional view, respectively, for illustrating a configuration of a heater in the second embodiment.
Figure 9B:
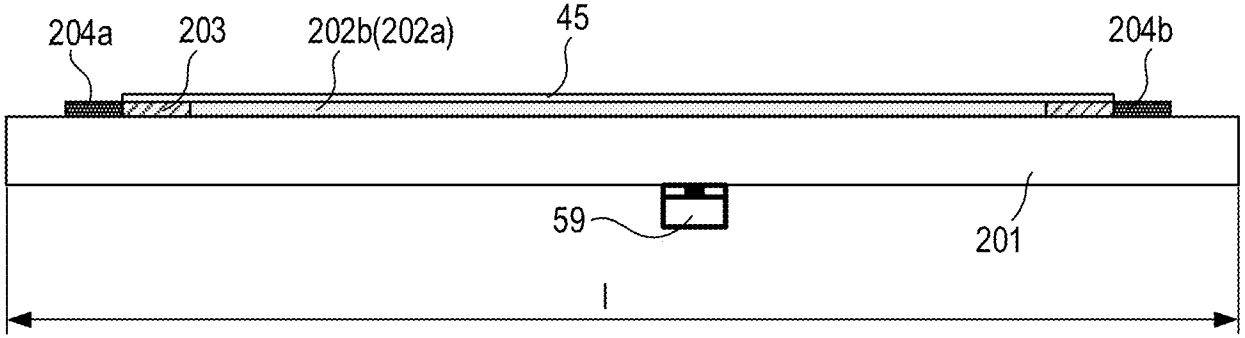
Figure 9C:
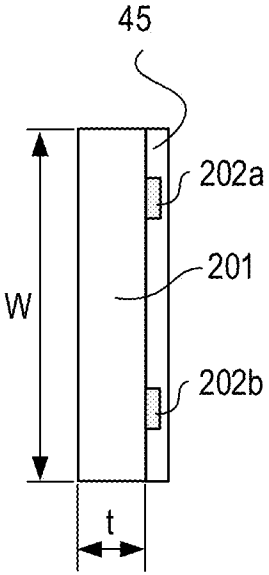

FIG. 9A, FIG. 9B, and FIG. 9C are a plan view, a side view, and a sectional view, respectively, in the longitudinal direction of the heater 54 in a second embodiment. The substrate 201 has dimensions of a thickness "t"=1 mm, a width W=7.0 mm, and a length "l"=280 mm. The heat generating elements 202*a* and 202*b* having the same dimension in a length 202*l* (=222 mm) are arranged side by side in a widthwise direction of the substrate 201. On the substrate 201, components are arranged in order of the contact 204*a*, the conductive path 203, the heat generating element 202*a*, the conductive path 203, and the contact 204*b* to be electrically connected in series to each other. The heat generating element 202*b* is also similarly connected and arranged on the substrate 201. The heat generating element 202*a* has an electric resistance value in the longitudinal direction of 21Ω, and the heat generating element 202*b* also has the electric resistance value of 21Ω. The heat generating elements 202*a* and 202*b* are connected in parallel to each other, and hence the two heat generating elements 202*a* and 202*b* have a combined electric resistance value of 10.5Ω. The heat generating elements 202*a* and 202*b* and the conductive paths 203 are covered with the glass 45 to maintain an insulating property. The fixing temperature sensor 59 configured to detect the temperature of the back side of the heater 54 is arranged at a substantially central portion in the longitudinal direction. The voltage to be input to the heat generating elements 202*a* and 202*b* is controlled based on the detection result of the fixing temperature sensor 59.

Figure 10A:
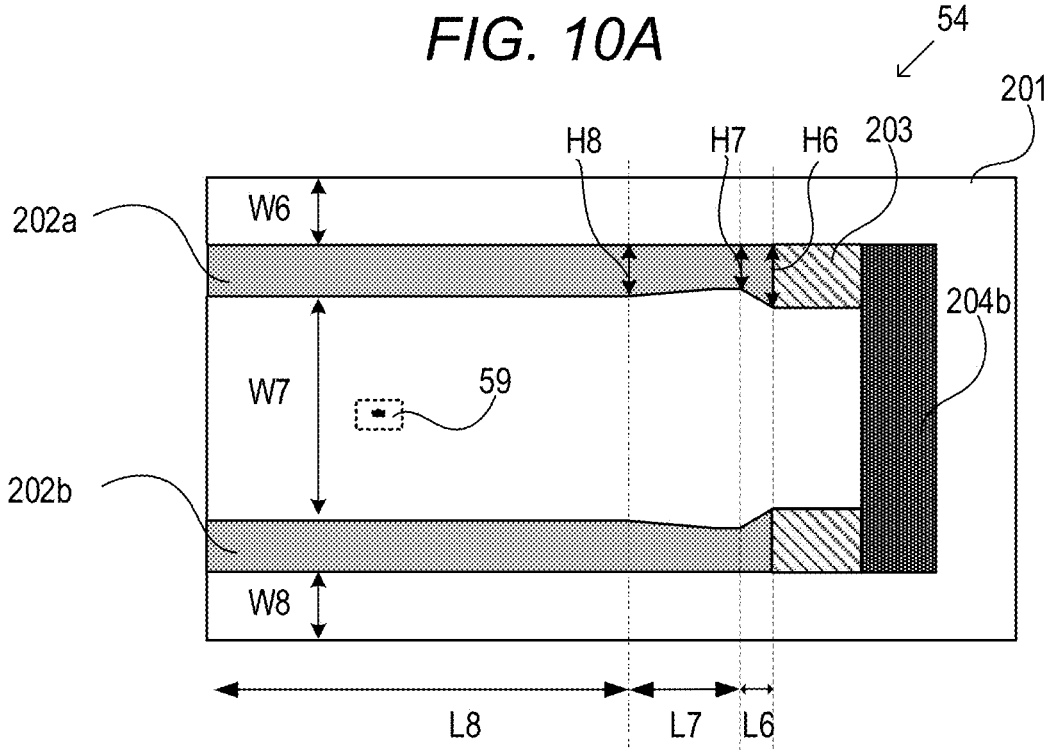
FIG. 10A, FIG. 10B, FIG. 10C and FIG. 10D are views for illustrating a positional relationship between the heater and each of sheets in the second embodiment.
Figure 10B:
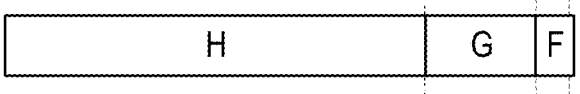

FIG. 10A is an enlarged view of the right half of the heater 54, in which a center in the longitudinal direction of the heat generating elements 202*a* and 202*b* in the second embodiment is illustrated at a left end. The heat generating elements 202*a* and 202*b* has a bilaterally symmetrical shape in the longitudinal direction, and hence description of the left half is omitted here. Now, the dimensions of the heat generating element 202*a* in the second embodiment are described. As illustrated in FIG. 10B, in the heat generating element 202*a*, an area in which the width in the widthwise direction is gradually decreased from the outer side in the longitudinal direction is referred to as "area F" corresponding to the first area. Further, an area in which the width is gradually increased from the width H7 toward the width H8 is referred to as "area G" corresponding to the second area, and an area having a constant width H8 is referred to as "area H" corresponding to the third area.

The area F is described. The width in the widthwise direction of the heat generating element 202*a* is gradually decreased from the width H6 to the width H7 toward the inner side in the longitudinal direction. The width H6 is 1.0 mm, and the width H7 is 0.7 mm. In FIG. 10A, the width of the area F is linearly decreased, but the width may be decreased in a curved shape. Further, the area F has a length L6 in the longitudinal direction of 6 mm. Next, the area G is described. The width in the widthwise direction of the heat generating element 202*a* is gradually increased from the width H7 to the width H8 toward the inner side in the longitudinal direction, and the width H8 is 0.8 mm That is, "H6>H8>H7" is satisfied. In FIG. 10A, the width of the area G is linearly increased, but the width may be increased in a curved shape. The area G has a length L7 in the longitudinal direction of 22 mm. The area H has a constant width in the widthwise direction of the heat generating element 202*a* of H8=0.8 mm, and the area H has a length L8 in the longitudinal direction of 83 mm. That is, "L8>L7>L6" is satisfied. A distance W6 between the heat generating element 202*a* and one end portion of the substrate 201, and a distance W8 between the heat generating element 202*b* and another end portion of the substrate 201 are both 1.0 mm, and a distance W7 between the heat generating element 202*a* and the heat generating element 202*b* is 3.4 mm. The heat generating element 202*b* is shaped to be symmetrical (vertically symmetrical) to the heat generating element 202*a* in the widthwise direction, and thus has the same dimensions as those of the heat generating element 202*a*.

The reason why the heat generating elements 202*a* and 202*b* are formed into the above-mentioned shape is because, as described in the first embodiment, it is desired that, when a voltage is applied to the heat generating elements 202*a* and 202*b*, the heat generation amount per unit length (energy density P) be larger in order of the area G, the area H, and the area F. When the energy densities of the areas F, G, and H are represented by P6, P7, and P8, respectively, a relationship of "P7>P8>P6" is satisfied. In this case, an average of the widths in the widthwise direction of the area F (average of the width H6 and the width H7) is referred to as "H67" (=(H6+H7)/2) corresponding to the first width, and an average of the widths in the widthwise direction of the area G (average of the width H7 and the width H8) is referred to as "H78" (=(H7+H8)/2) corresponding to the second width. In this case, in the heat generating elements 202*a* and 202*b* in the second embodiment, a relationship of "H67>H8>H78" is satisfied. In this manner, the area F being the outermost area in the longitudinal direction of each of the heat generating elements 202*a* and 202*b* has the smallest electric resistance value R6 per unit length, and the area G adjacent to the outermost area has the largest electric resistance value R7. The area H at the central portion in the longitudinal direction has an intermediate electric resistance value R8. In this manner, the electric resistance value per unit length can be set to be larger in order of the area G, the area H, and the area F. That is, "R7>R8>R6" is satisfied. In this manner, when a voltage is applied to the heat generating elements 202*a* and 202*b*, the heat generation amount per unit length (energy density) can be set to be larger in order of the area G, the area H, and the area F. That is, the relationship of "P7>P8>P6" is satisfied.

In the second embodiment, unlike the first embodiment, the width in the widthwise direction of each of the heat generating elements 202*a* and 202*b* is gradually changed in the area F and the area G. The area F being the outermost area is gradually increased in width in the widthwise direction toward the outer side in the longitudinal direction, and is decreased in energy density toward the outer side in the longitudinal direction. In contrast, the area G is gradually increased in width in the widthwise direction toward the inner side in the longitudinal direction, and is decreased in energy density toward the inner side in the longitudinal direction.

Figure 10C:
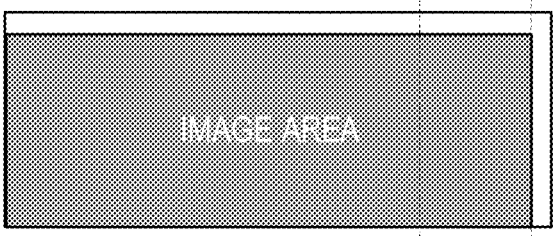
Figure 10D:
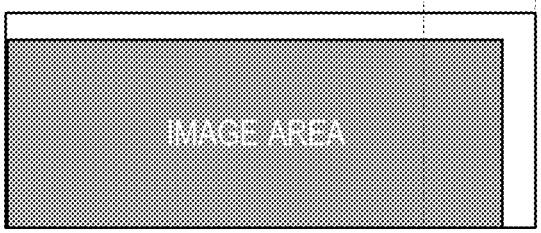

FIG. 10C is a view for illustrating an LTR sheet corresponding to a first sheet having a largest length in the longitudinal direction, and FIG. 10D is a view for illustrating an A4 sheet corresponding to a second sheet having the second largest length in the longitudinal direction after the first sheet. A positional relationship between the sheet P and the heat generating elements 202*a* and 202*b* is described. A leading end of the sheet and a right end of the sheet both have a margin of 5 mm, and an area of an image other than the margin is defined as an image area. A trailing end of the sheet and a left end of the sheet are not shown, but both of the ends have a margin of 5 mm. Similarly to the description of the first embodiment, the end portion of the A4 sheet is included in the area F having a low energy density, and the end portion of the image area of the LTR sheet is included in the area G having a high energy density, and hence the suppression of the excessive temperature rise at the non-sheet passing portion and the reduction of the end temperature sagging can be both achieved.

In the second embodiment, in the outermost area F in the longitudinal direction, the energy density is gradually decreased toward the outer side in the longitudinal direction. Therefore, unlike the first embodiment, the energy density does not steeply change in the vicinity of the boundary between the area F and the area G which are formed on the outer side and the inner side, respectively, of the end portion of the image area of the LTR sheet. Description is given of a case in which, in the configuration of the second embodiment, the LTR sheet is conveyed in a state of being shifted to the outer side in the longitudinal direction (hereinafter referred to as "conveyance misalignment"), and the end portion of the image area of the LTR sheet enters the area F having the low energy density. Even in the case of such a situation, the end temperature sagging is small in the image area of the LTR sheet, and such a problem that the toner at the end portion of the image area cannot be fixed to the LTR sheet can be solved. Further, in the area G, the energy density is gradually decreased toward the inner side in the longitudinal direction. The end temperature sagging causes a larger temperature drop amount toward the outer side in the longitudinal direction. The area G does not waste energy when the energy density of each of the heat generating elements is higher in an outer area causing large temperature sagging, and the energy density of each of the heat generating elements 202*a* and 202*b* is lower in an inner area causing small end temperature sagging. The energy is not wasted, and accordingly the temperature rise at the non-sheet passing portion when the sheet P is conveyed can be reduced.

Effects of Second Embodiment (i) Temperature Drop Amount at End Portion in Longitudinal Direction (End Temperature Sagging)

Figure 11A:
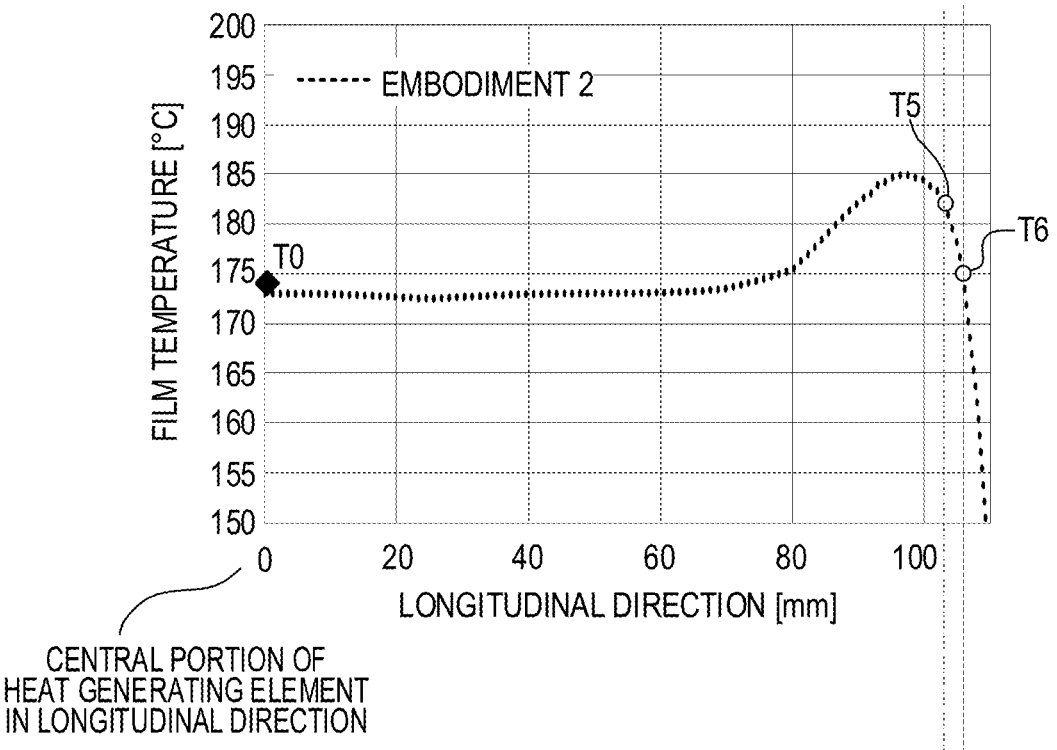
FIG. 11A is a graph for showing a film temperature in the second embodiment.
Figure 11B:
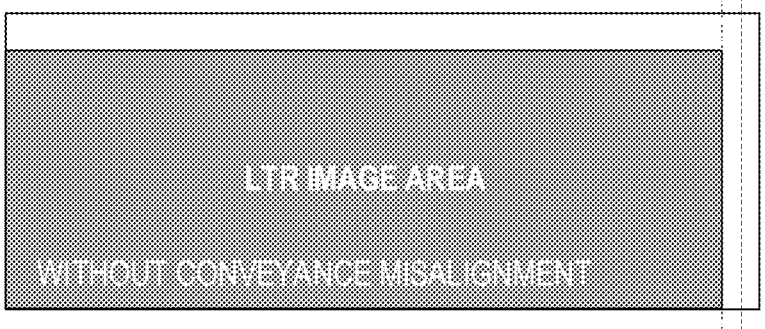
FIG. 11B is a view for illustrating positions of a sheet and an image area in a case without conveyance misalignment.
Figure 11C:
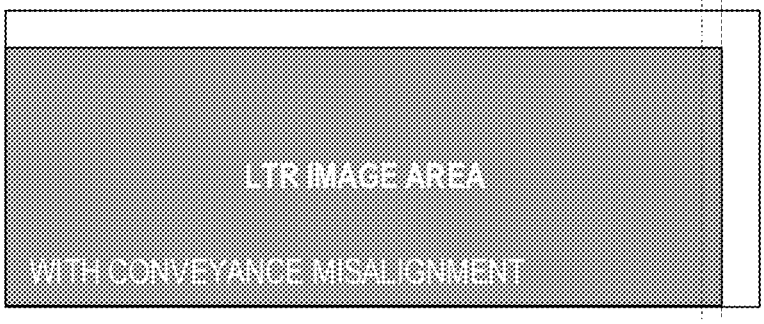
FIG. 11C is a view for illustrating positions of the sheet and the image area in a case with conveyance misalignment.

In order to verify the effects of the second embodiment, the temperature drop amount (sagging) at the end portion of each of the heat generating elements 202*a* and 202*b* in the longitudinal direction and the temperature rise at the non-sheet passing portion when A4 sheets were continuously passed were verified by a method similar to that in the comparative investigation of the first embodiment. FIG. 11A shows verification results of the temperature drop amount at the end portion of the film 51 in the longitudinal direction. In FIG. 11A, the horizontal axis indicates a position in the longitudinal direction (mm), and the vertical axis indicates a temperature of the film 51 (° C.). Further, FIG. 11B is an illustration of the LTR sheet and the image area corresponding to the position in the longitudinal direction of FIG. 11A in a case without the conveyance misalignment. FIG. 11C is an illustration of the LTR sheet and the image area corresponding to the position in the longitudinal direction of FIG. 11A in a case with the conveyance misalignment. In the second embodiment, a temperature T0 of the film 51 at the central portion in the longitudinal direction was about 173° C., and a temperature T5 of the film 51 at the position of the end portion of the image area of the LTR sheet was about 182° C. The temperature T5 of the film 51 at the end portion of the image area of the LTR sheet was higher than the temperature T0 at the central portion in the longitudinal direction (T5>T0), and thus the end temperature sagging was able to be solved.

Further, assuming the conveyance misalignment of the sheet P, a temperature T6 of the film 51 at a position on the outer side by 3 mm from the position of the end portion of the image area of the LTR sheet was measured. In this case, the temperature T6 was about 175° C. Also in this case, the temperature T6 was higher than the temperature T0 at the central portion (T6>T0). Thus, even when the conveyance misalignment of the sheet P occurs, such a problem that the toner at the end portion of the image area cannot be fixed to the sheet P can be solved.

Figure 12A:
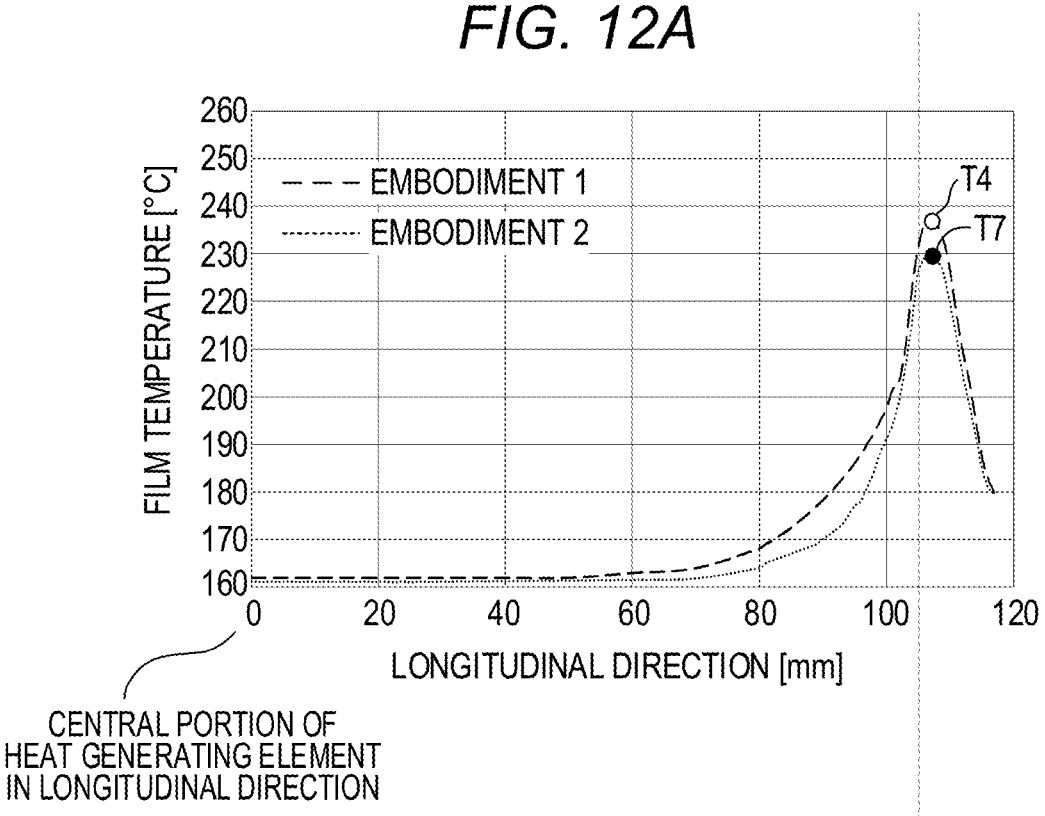
FIG. 12A is a graph for showing a film temperature in the second embodiment.
Figure 12B:
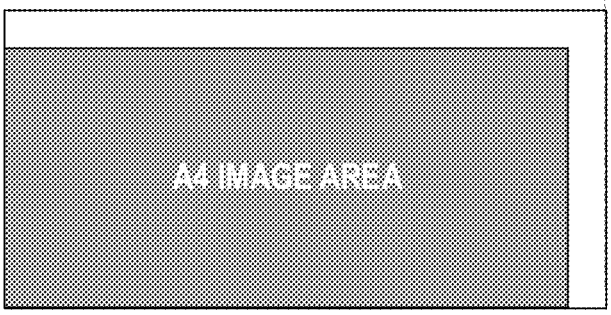
FIG. 12B is a view for illustrating positions of a sheet and an image area.

(ii) Temperature Rise at Non-Sheet Passing Portion when A4 Sheets are Continuously Passed FIG. 12A shows verification results of the temperature rise at the non-sheet passing portion when the A4 sheets are continuously conveyed. The broken line indicates the result of the first embodiment, and the dotted line indicates the result of the second embodiment. FIG. 12B is an illustration of the A4 sheet and the image area corresponding to the position in the longitudinal direction of FIG. 12A. In the second embodiment, a temperature of the film 51 at the non-sheet passing area of the A4 sheets was T7=228° C., and it was verified that the excessive temperature rise at the non-sheet passing portion was suppressed. The temperature T4 at the non-sheet passing area in the first embodiment was 236° C., and hence it was verified that the effect of suppressing the temperature rise at the non-sheet passing portion was increased in the second embodiment. The film 51 had a low temperature in an area of from 70 mm to 100 mm in the longitudinal direction, and the energy waste was also reduced. As a result, the temperature rise at the non-sheet passing portion was able to be reduced.

As described above, in the second embodiment, the heat generating elements 202*a* and 202*b* are formed as follows in the area from the end portion to the central portion in the longitudinal direction. Each of the heat generating elements 202*a* and 202*b* is sectioned into the first area, the second area, and the third area in order from the end portion of each of the heat generating elements 202*a* and 202*b*. In this case, the length (width) in the widthwise direction of each of the heat generating elements 202*a* and 202*b* is set to be smaller in order of the second area, the third area, and the first area. Therefore, the electric resistance value per unit length is set to be larger in order of the second area, the third area, and the first area, and the heat generation amount per unit length (energy density) is set to be larger in order of the second area, the third area, and the first area. Further, the heat generating elements 202*a* and 202*b* are formed so that the end portion of the image area of the first sheet having the largest sheet width in the longitudinal direction is included in the second area, and the end portion of the second sheet having the second largest sheet width in the longitudinal direction after the first sheet is included in the first area. In this manner, the end temperature sagging of each member to be caused when the sheet P having the largest sheet width in the longitudinal direction is conveyed, and the excessive temperature rise at the non-sheet passing portion to be caused when the second sheet having the second largest sheet width in the longitudinal direction is passed can be both suppressed.

Further, in the first area of each of the heat generating elements 202*a* and 202*b*, the electric resistance value per unit length of each of the heat generating elements 202*a* and 202*b* is gradually increased from the end portion toward the central portion of each of the heat generating elements 202*a* and 202*b*. In this manner, even when the conveyance misalignment of the sheet P occurs, the toner on the sheet P can be fixed. Further, in the second area, the electric resistance value per unit length of each of the heat generating elements 202*a* and 202*b* is gradually decreased from the end portion toward the central portion of each of the heat generating elements 202*a* and 202*b*. In this manner, the effect of suppressing the excessive temperature rise at the non-sheet passing portion when the second sheet is conveyed can be further increased.

In the second embodiment, the heat generating elements 202*a* and 202*b* are formed so that, in the area F, the electric resistance value is gradually decreased toward the outer side in the longitudinal direction, and, in the area G, the electric resistance value is gradually increased toward the outer side in the longitudinal direction. As a method of achieving this configuration, the width in the widthwise direction of each of the heat generating elements 202*a* and 202*b* is changed linearly in the longitudinal direction, but similar effects can be obtained even when the width in the widthwise direction thereof is changed in a curved or stepwise shape.

As described above, according to the second embodiment, the temperature drop at the end portion in the longitudinal direction of each member of the fixing apparatus and the temperature rise at the non-sheet passing portion can be both suppressed.

Third Embodiment

[Heater]

FIG. 13A is a plan view in the longitudinal direction of the heater 54 in a third embodiment. A substrate 301 has the same dimensions as those of Embodiments 1 and 2, which are the thickness "t"=1 mm, the width W=7.0 mm, and the length "l"=280 mm. Heat generating elements 302*a* and 302*b* each have a length 302*l* in the longitudinal direction of 222 mm, and are arranged side by side in the widthwise direction. The heat generating element 302*a* includes heat generating portions 305*a*, 306*a*, 307*a*, 308*a*, and 309*a* made of different materials. The heat generating portion 305*a* and the heat generating portion 309*a* are made of the same material, and the heat generating portion 306*a* and the heat generating portion 308*a* are made of the same material. End portions of the heat generating element 302*a* are electrically connected to conductive paths 303 and contacts 304*a* and 304*b* for supplying electric power. The heat generating element 302*b* has the same configuration as that of the heat generating element 302*a*, and the heat generating element 302*a* and the heat generating element 302*b* have a combined electric resistance value of 10.5Ω.

FIG. 13B is an enlarged view of the right half of the heater 54, in which a central portion in the longitudinal direction of the heat generating elements 302*a* and 302*b* in the third embodiment is illustrated at a left end. The heat generating elements 302*a* and 302*b* each have a bilaterally symmetrical shape, and hence description of the left half is omitted here. Now, the dimensions of the heat generating element 302*a* are described. The heat generating element 302*a* has a constant width in the widthwise direction of H9=0.8 mm regardless of the position in the longitudinal direction. The heat generating portion 309*a* positioned on the outer side in the longitudinal direction has a length L9 in the longitudinal direction of 6 mm, and the heat generating portion 307*a* positioned on the central side in the longitudinal direction has a length L11 in the longitudinal direction of 83 mm. The intermediate heat generating portion 308*a* has a length L10 in the longitudinal direction of 22 mm (L11>L10>L9). As illustrated in FIG. 13C, an area of the heat generating portion 309*a* is referred to as "area I" corresponding to the first area, an area of the heat generating portion 308*a* is referred to as "area J" corresponding to the second area, and an area of the heat generating portion 307*a* is referred to as "area K" corresponding to the third area. When an electric resistivity of a heat generating material to be used for the heat generating portion 307*a* is assumed to be 1, electric resistivities of the heat generating portion 305*a* and the heat generating portion 309*a* are 0.875, and electric resistivities of the heat generating portion 306*a* and the heat generating portion 308*a* are 1.25. That is, when a first electric resistivity of the area I is represented by "ρ1", a second electric resistivity of the area J is represented by "ρ2", and a third electric resistivity of the area K is represented by "ρ3", a relationship of "ρ2>ρ3>ρ1" is satisfied. A distance W9 between the heat generating element 302*a* and one end portion of the substrate 301 is 1.0 mm, and a distance W11 between the heat generating element 302*b* and another end portion of the substrate 301 is also 1.0 mm. A distance W10 between the heat generating element 302*a* and the heat generating element 302*b* is 3.4 mm. The heat generating element 302*b* is shaped to be vertically symmetrical (symmetrical in the widthwise direction) to the heat generating element 302*a*, and hence has the same dimensions as those of the heat generating element 302*a*.

In this manner, the heat generating elements 302*a* and 302*b* can be formed so that the area I being the outermost area in the longitudinal direction has the smallest electric resistance value per unit length, the area J adjacent to the outermost area has the largest electric resistance value, and the area K at the central portion in the longitudinal direction has an intermediate electric resistance value. The electric resistance value per unit length is larger in order of the area J, the area K, and the area I. That is, when the electric resistance value of the area I is represented by R9, the electric resistance value of the area J is represented by R10, and the electric resistance value of the area K is represented by R11, a relationship of "R10>R11>R9" is satisfied. That is, when a voltage is applied to the heat generating element, the energy density per unit length can be set to be larger in order of the area J, the area K, and the area I. That is, when the energy density of the area I is represented by P9, the energy density of the area J is represented by P10, and the energy density of the area K is represented by P11, a relationship of "P10>P11>P9" is satisfied. The positional relationship in the longitudinal direction between each of the area I, the area J, and the area K and each of the end portion of the image area of the LTR sheet and the end portion of the A4 sheet is the same as that in the first embodiment. In the first embodiment and the second embodiment, there is selected a method of changing the width in the widthwise direction of the heat generating element depending on the position in the longitudinal direction. Meanwhile, in the third embodiment, the electric resistivity of the used material is changed depending on the position in the longitudinal direction of the heat generating element. Even with this method, effects equivalent to those of the first embodiment and the second embodiment can be obtained.

As described above, according to Embodiment 3, the temperature drop at the end portion in the longitudinal direction of each member of the fixing apparatus and the temperature rise at the non-sheet passing portion can be both suppressed.

Fourth Embodiment

FIG. 14A is a plan view in the longitudinal direction of the heater 54 in a fourth Embodiment. A substrate 401 has the same dimensions as those of the heater 54 in the first embodiment, which are the thickness "t"=1 mm, the width W=7.0 mm, and the length "l"=280 mm. Heat generating elements 402*a* and 402*b* each have a width H12 of 0.8 mm in the widthwise direction and a length 402*l* in the longitudinal direction of 222 mm, and are arranged side by side in the widthwise direction. The heat generating element 402*a* includes heat generating portions 405*a*, 406*a*, 407*a*, 408*a*, and 409*a* having different thicknesses. The heat generating portion 405*a* and the heat generating portion 409*a* have the same thickness, and the heat generating portion 406*a* and the heat generating portion 408*a* have the same thickness. End portions of the heat generating element 402*a* are electrically connected to conductive paths 403 and contacts 404*a* and 404*b* for supplying electric power. The heat generating element 402*b* has the same configuration as that of the heat generating element 402*a*, and the heat generating element 402*a* and the heat generating element 402*b* have a combined electric resistance value of 10.5Ω. A distance W12 between the heat generating element 402*a* and one end portion of the substrate 401 is 1.0 mm, and a distance W14 between the heat generating element 402*b* and another end portion of the substrate 401 is also 1.0 mm. A distance W13 between the heat generating element 402*a* and the heat generating element 402*b* is 3.4 mm.

FIG. 14B is a sectional view taken along the line XIVB-XIVB of FIG. 14A, of the right half of the heater 54, in which a center in the longitudinal direction of the heat generating element 402*a* in the fourth embodiment is illustrated at a left end. The heat generating element 402*a* has a bilaterally symmetrical shape in the longitudinal direction, and hence description of the left side is omitted here. The heat generating portion 409*a* on the outer side in the longitudinal direction has a first thickness T1 of 12 μm, and a length L12 in the longitudinal direction of 6 mm. The heat generating portion 407*a* on the central side in the longitudinal direction has a third thickness T3 of 10 μm, and a length L14 in the longitudinal direction of 83 mm. The heat generating portion 408*a* between the outer side and the central side has a second thickness T2 of 8.75 μm, and a length L13 in the longitudinal direction of 22 mm. That is, "L14>L13>L12" is satisfied, and "T1>T3>T2" is satisfied. As illustrated in FIG. 14C, an area of the heat generating portion 409*a* is referred to as "area L" corresponding to the first area, an area of the heat generating portion 408*a* is referred to as "area M" corresponding to the second area, and an area of the heat generating portion 407*a* is referred to as "area N" corresponding to the third area. The overall heat generating element 402*a* is made of the same material.

When the thickness of each of the heat generating elements 402*a* and 402*b* is changed, the area L being the outermost area can have the smallest electric resistance value per unit length, the area M adjacent to the outermost area can have the largest electric resistance value, and the area N at the central portion in the longitudinal direction can have an intermediate electric resistance value. The electric resistance value per unit length is larger in order of the area M, the area N, and the area L. That is, when the electric resistance value of the area L is represented by R12, the electric resistance value of the area M is represented by R13, and the electric resistance value of the area N is represented by R14, a relationship of "R13>R14>R12" is satisfied. That is, when a voltage is applied to the heat generating elements 402*a* and 402*b*, the energy density per unit length can be set to be larger in order of the area M, the area N, and the area L. That is, when the energy density of the area L is represented by P12, the energy density of the area M is represented by P13, and the energy density of the area N is represented by P14, a relationship of "P13>P14>P12" is satisfied.

The positional relationship in the longitudinal direction between each of the area L, the area M, and the area N and each of the end portion of the image area of the LTR sheet and the end portion of the A4 sheet is the same as that in the first embodiment. In the first embodiment and the second embodiment, there is selected a method of changing the width in the widthwise direction of the heat generating element depending on the position in the longitudinal direction. Meanwhile, in the fourth embodiment, the thickness of each of the heat generating elements 402*a* and 402*b* is changed depending on the position in the longitudinal direction of each of the heat generating elements 402*a* and 402*b*, to thereby change the electric resistance value. Even with this method, effects equivalent to those of the first embodiment and the second embodiment can be obtained.

[Other Configuration Examples of Heater]

Figure 15A:
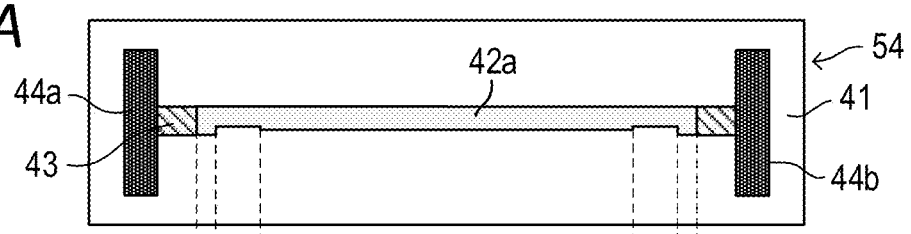
FIG. 15A, FIG. 15B, FIG. 15C, FIG. 15D, FIG. 15E and FIG. 15F are plan views for illustrating configurations of other heaters in the fourth embodiment.
Figure 15B:
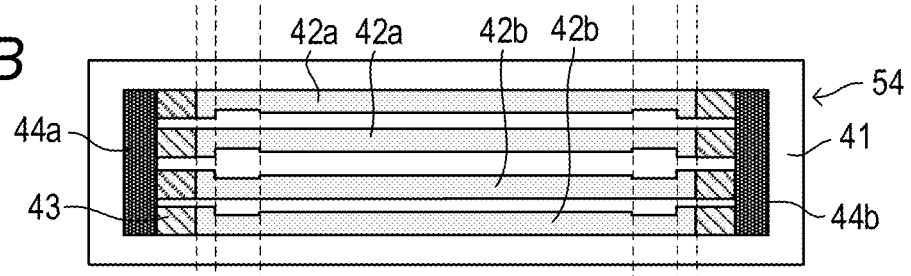

FIG. 15A, FIG. 15B, FIG. 15C, FIG. 15D, FIG. 15E, and FIG. 15F are illustrations of other embodiments. In FIG. 15A, FIG. 15B, FIG. 15C, FIG. 15D, FIG. 15E, and FIG. 15F, the heat generating element 42*a* (and/or 42*b*) in the first embodiment is illustrated as an example, but the heat generating element 42*a* (and/or 42*b*) may be replaced with the heat generating elements described in the second to fourth Embodiments. In the first to fourth Embodiments, description has been given of the heater 54 in which two heat generating elements are arranged side by side in the widthwise direction, but similar effects can be obtained even when the number of heat generating elements is one or larger than two as illustrated in FIG. 15A and FIG. 15B. That is, the heater 54 may include a plurality of heat generating elements. For example, in FIG. 15A, the heater 54 includes one heat generating element 42*a*. In this case, it is preferred to arrange the heat generating element 42*a* (or 42*b*) at a central portion of the substrate 41 in the widthwise direction. The heat generating element 42*a* may be arranged at any position of the substrate 41 in the widthwise direction. Further, as illustrated in FIG. 15B, one heat generating element having the same shape as that of the heat generating element 42*a* and one heat generating element having the same shape as that of the heat generating element 42*b* may be arranged between the heat generating element 42*a* and the heat generating element 42*b* of FIG. 5A in the first embodiment. As described above, a plurality of heat generating elements 42*a* and a plurality of heat generating elements 42*b* may be arranged on the substrate 41 so as to be symmetrical in the widthwise direction.

Figure 15C:
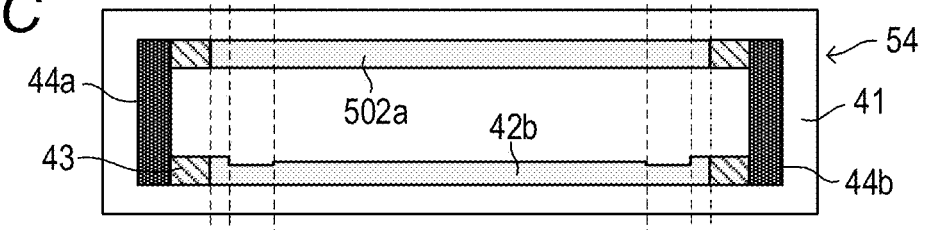

In the first to fourth embodiments, description has been given of the heater in which two heat generating elements having the same shape are arranged side by side in the widthwise direction, but as illustrated in FIG. 15C, the heat generating elements are not required to have the same shape. For example, one heat generating element may be a cuboid heat generating element 502*a*, and the other heat generating element may be, for example, the heat generating element

Figure 15D:
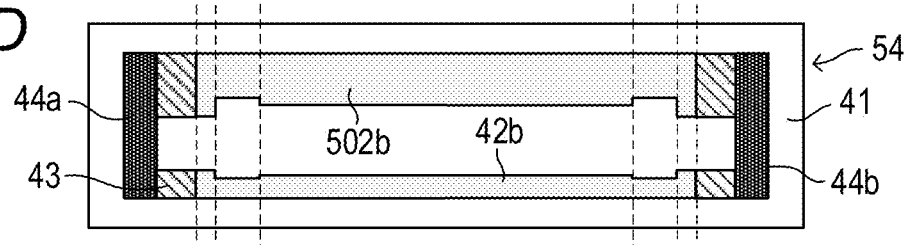

42*b*. As described above, only one heat generating element may be formed into the shape described in each of the first to fourth embodiments. Further, as illustrated in FIG. 15D, for example, the widths of the heat generating elements may be changed so that the heat generating elements have different resistance values. That is, as in a heat generating element 502*b*, for example, the width in the widthwise direction may be made larger than that of the heat generating element 42*b*. For example, when both of the heat generating elements cannot fall within the fixing nip portion N, and one heat generating element protrudes out of the fixing nip portion N, the temperature of the protruding heat generating element steeply rises. The steep temperature rise can be reduced when the heat generating element is formed into a cuboid shape having small heat generation unevenness or when the heat generating element has a high resistance value, and hence the shapes of the heat generating element 502*a* of FIG. 15C and the heat generating element 502*b* of FIG. 15D are desired.

Figure 15E:
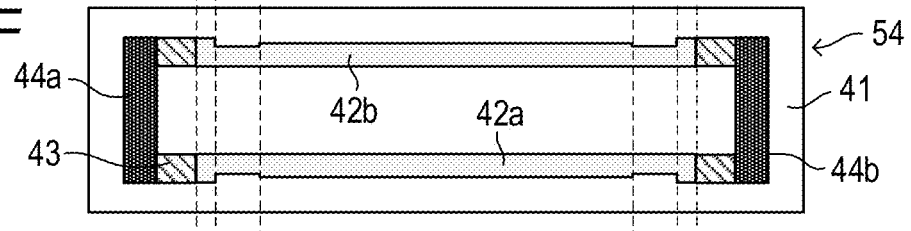
Figure 15F:
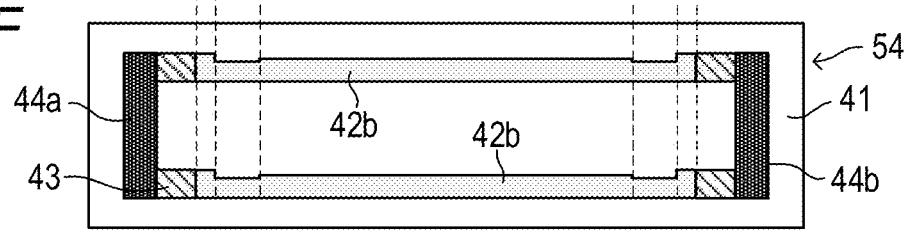

Further, as illustrated in FIG. 15E, the heat generating element described in the first embodiment may have a vertically-inverted shape. That is, in the first embodiment, the heat generating element 42*a* is arranged at one end portion of the substrate 41 in the widthwise direction, and the heat generating element 42*b* is arranged at another end portion thereof. However, as illustrated in FIG. 15E, the heat generating element 42*b* may be arranged at one end portion of the substrate 41 in the widthwise direction, and the heat generating element 42*a* may be arranged at another end portion thereof. Further, as illustrated in FIG. 15F, the substrate 41 may not be symmetrical in the widthwise direction. That is, two heat generating elements 42*a* may be arranged on the substrate 41, or two heat generating elements 42*b* (FIG. 15F) may be arranged on the substrate 41. As described above, the shape, number, arrangement, and the like of the heat generating elements can be variously combined depending on the specification of the image forming apparatus 170 on which the heater 54 is mounted.

The sheet P is conveyed while being shifted to one end side in the longitudinal direction depending on the type of the image forming apparatus 170. In such an apparatus, the heat generating element is not required to be symmetrical in the longitudinal direction. The features of the heat generating element described in the first embodiment or the like may be applied only in the direction opposite to the direction in which the sheet P is shifted.

[Application to Image Forming Apparatus Adapted to A3 Size]

Figures 16A, 16B, 16C, 16D:
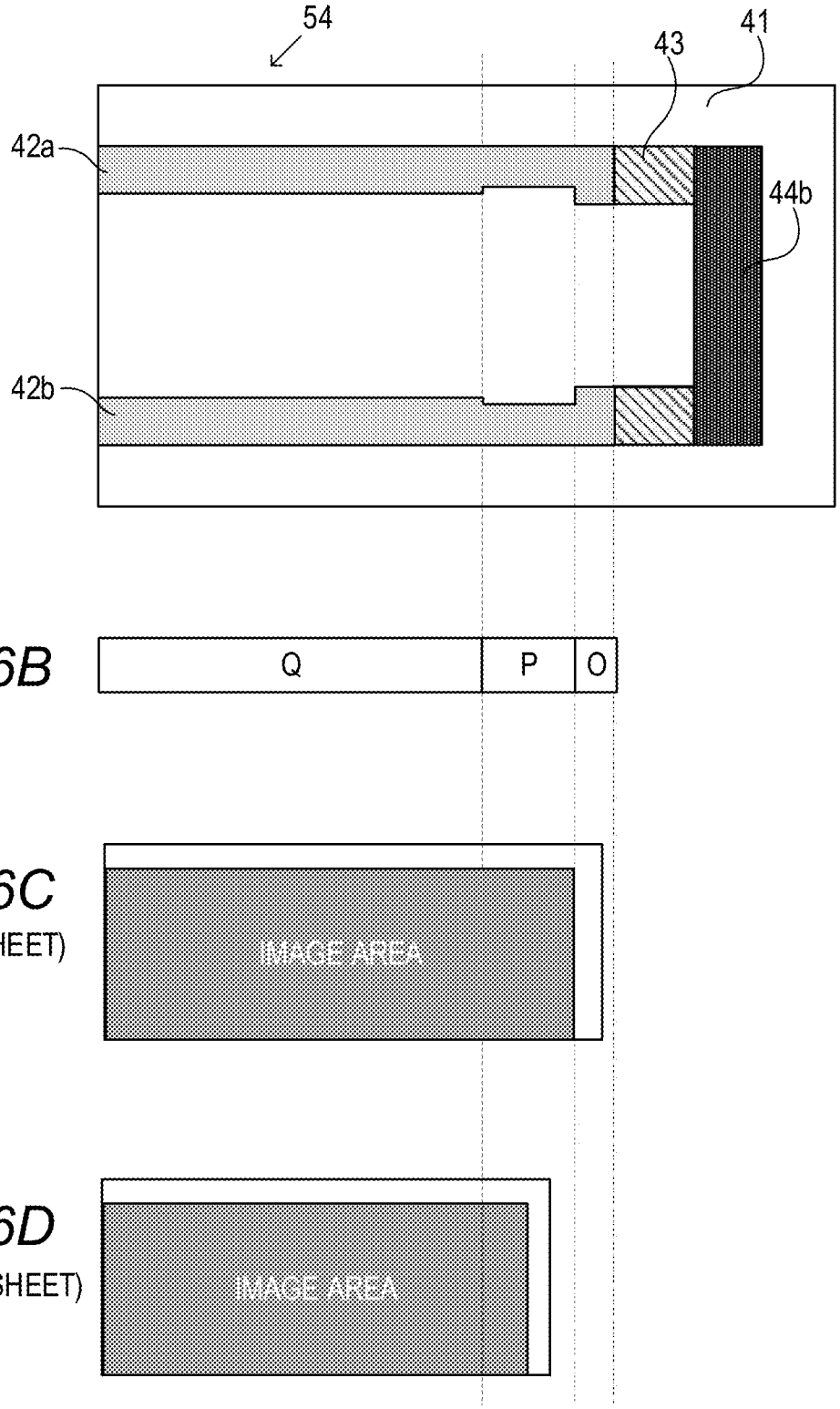
FIG. 16A, FIG. 16B, FIG. 16C and FIG. 16D are views for illustrating a positional relationship between the heater in the fourth embodiment and each of sheets.

FIG. 16A is an illustration of a positional relationship between the sheet P and the heat generating elements 42*a* and 42*b* when the heater 54 described in the first embodiment is applied to an A3 printer (image forming apparatus 170 adapted to an A3-sized sheet). In the A3 printer, the first sheet having the largest sheet width in the longitudinal direction is A3 (W=297 mm, "l"=420 mm) and A4 (W=297 mm, "l"=210 mm), and the second sheet having the second largest sheet width in the longitudinal direction is LTR (W=279 mm, "l"=216 mm). The A3 sheet is conveyed with its short side (W=297 mm) being oriented as the leading edge in the conveyance direction CD, and the A4 sheet is conveyed with its long side (W=297 mm) being oriented as the leading edge in the conveyance direction CD. The LTR sheet is conveyed with its long side (W=297 mm) being oriented as the leading edge in the conveyance direction CD.

Further, as illustrated in FIG. 16B, each of the heat generating elements 42*a* and 42*b* is sectioned into a first area O, a second area P, and a third area Q in order from the end portion in the longitudinal direction. The areas O, P, and Q have energy densities P1, P2, and P3, respectively, satisfying a relationship of "P2>P3>P1." Even the A3 printer is desired to have the same relationship as that of the A4 printer. FIG. 16C is a view for illustrating the positions of the A3 sheet and the image area. FIG. 16D is a view for illustrating the positions of the LTR sheet and the image area. In the positional relationship between the sheet P and each of the heat generating elements 42*a* and 42*b*, it is desired that the end portion of the image area of the A3 sheet corresponding to the first sheet having the largest sheet width in the longitudinal direction be included in the area P having a high energy density so that priority is given to suppression of the end temperature sagging. The end portion of the LTR sheet having the second largest sheet width in the longitudinal direction after the first sheet may be included in the area P. The area O has a low energy density, and hence even when the end portion of the LTR sheet is included in the area P, the effect of suppressing the temperature rise at the non-sheet passing portion can be expected.

As described above, according to the fourth embodiment, the temperature drop at the end portion in the longitudinal direction of each member of the fixing apparatus and the temperature rise at the non-sheet passing portion can be both suppressed.

Fifth Embodiment

Figure 17A:
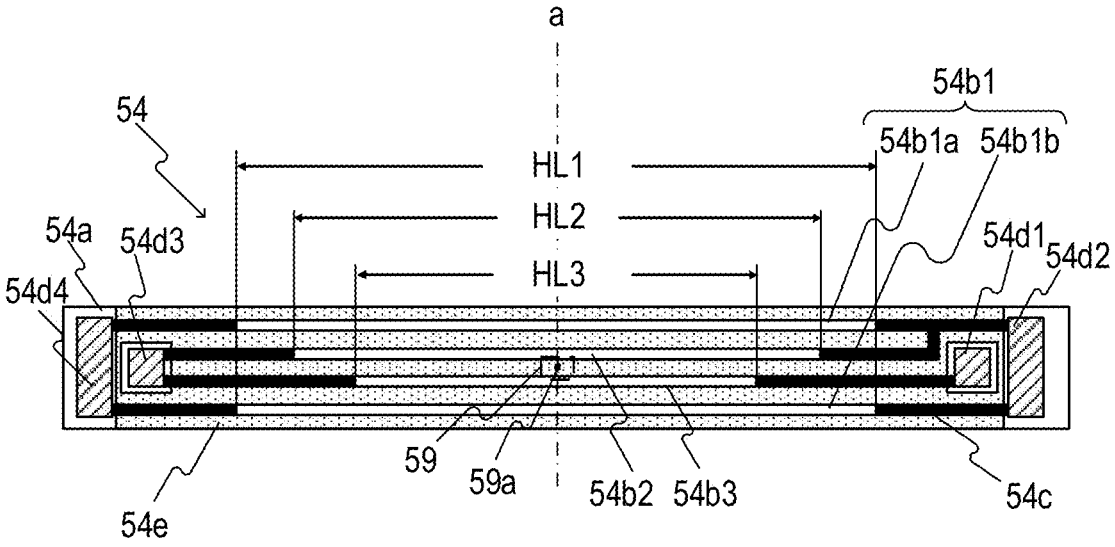
FIG. 17A is a plan view of a heater in the fifth embodiment.
Figure 17B:
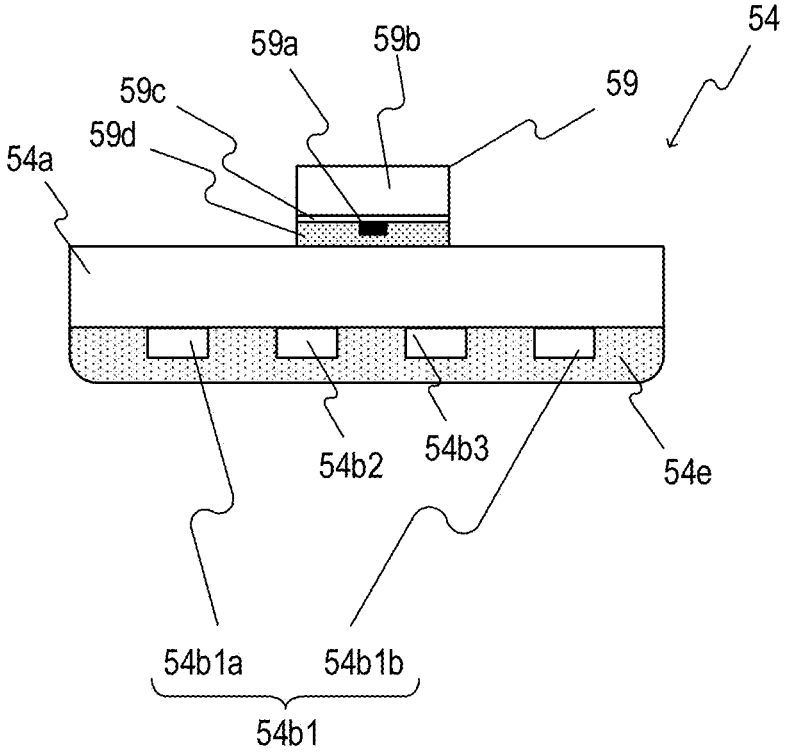
FIG. 17B is a sectional view of the heater in the fifth embodiment.

A fifth Embodiment is an embodiment of a case in which the heater 54 including three heat generating elements having different lengths in the orthogonal direction with respect to the conveyance direction (widthwise direction; width direction of a sheet) as illustrated in FIG. 17A and FIG. 17B is used. FIG. 17A is a schematic view of the heater in the fifth embodiment (heater 54 including three heat generating elements having different lengths). In FIG. 17A, each heat generating element is illustrated as having a cuboid shape (rectangular shape in plan view), but actually has a characteristic shape of the present invention as described in the first to fourth embodiments.

The heater 54 is formed of a substrate 54*a*, a heat generating element 54*b*1*a* being a first heat generating element, a heat generating element 54*b*1*b* being a fourth heat generating element, a heat generating element 54*b*2 being a second heat generating element, a heat generating element 54*b*3 being a third heat generating element, a conductor 54*c*, contacts 54*d*1 to 54*d*4, and a protection glass layer 54*e*. In the following, the heat generating elements 54*b*1*a*, 54*b*1*b*, 54*b*2, and 54*b*3 are collectively referred to as "heat generating elements 54*b*" in some parts. Moreover, the heat generating elements 54*b*1*a* and 54*b*1*b* having substantially the same length in the longitudinal direction are collectively referred to as "heat generating elements 54*b*1" in some parts. The substrate 54*a* is made of alumina ($Al_2O_3$) being ceramics. The heat generating elements 54*b*1*a*, 54*b*1*b*, 54*b*2, and 54*b*3, the conductor 54*c*, and the contacts 54*d*1 to 54*d*4 are formed on the substrate 54*a*. Further, the protection glass layer 54*e* is formed thereon to secure insulation between the heat generating elements 54*b*1*a*, 54*b*1*b*, 54*b*2, and 54*b*3 and the film 51.

The heat generating elements 54*b* are different in length (hereinafter also referred to as "size") in the longitudinal direction. The heat generating elements 54*b*1*a* and 54*b*1*b* each have a length in the longitudinal direction of HL1=222 mm. The heat generating element 54*b*2 has a length in the longitudinal direction of HL2=188 mm. The heat generating element 54*b*3 has a length in the longitudinal direction of HL3=154 mm. The lengths HL1, HL2, and HL3 have a relationship of "HL1>HL2>HL3."

Moreover, the largest sheet width (hereinafter referred to as "maximum sheet width") in a sheet which can be used in the image forming apparatus 170 according to the fifth embodiment is 216 mm, and the smallest sheet width (hereinafter referred to as "minimum sheet width") is 76 mm. Thus, the first length HL1 is set to such a length that an image size (206 mm) having the maximum sheet width (216 mm) can be fixed by the heat generating elements 54*b*1. The heat generating elements 54*b*1 are electrically connected to the contact 54*d*2 being a second contact and the contact 54*d*4 being a fourth contact through intermediation of the conductor 54*c*, and the heat generating element 54*b*2 is electrically connected to the contacts 54*d*2 and 54*d*3 through intermediation of the conductor 54*c*. The heat generating element 54*b*3 is electrically connected to the contact 54*d*1 being a first contact and the contact 54*d*3 being a third contact through intermediation of the conductor 54*c*. Here, the heat generating element 54*b*1*a* and the heat generating element 54*b*1*b* have the same lengths and are always used substantially at the same time. The heat generating element 54*b*1*a* is provided at one end portion in a widthwise direction of the substrate 54*a*, and the heat generating element 54*b*1*b* is provided at another end portion in the widthwise direction of the substrate 54*a*. The heat generating elements 54*b*2 and 54*b*3 are provided between the heat generating element 54*b*1*a* and the heat generating element 54*b*1*b* in the widthwise direction of the substrate 54*a* in such a manner as to be symmetrical with respect to a center in the widthwise direction. The switching of the power supply paths, that is, the switching of the heat generating elements 54*b* is performed by the CPU 94 controlling the heat generating element switcher 57 described with reference to FIG. 2.

The fixing temperature sensor 59 being a temperature detecting unit is a thermistor. A configuration of the fixing temperature sensor 59 is described with reference to FIG. 17B. The fixing temperature sensor 59 illustrated in FIG. 17B is formed of a main thermistor element 59*a*, a holder 59*b*, a ceramic paper 59*c*, and an insulation resin sheet 59*d*. The ceramic paper 59*c* has a role of hindering heat conduction between the holder 59*b* and the main thermistor element 59*a*. The insulation resin sheet 59*d* has a role of physically and electrically protecting the main thermistor element 59*a*. The main thermistor element 59*a* is a temperature detecting unit having an output value that is changed in accordance with the temperature of the heater 54, and is connected to a CPU (not shown) of the image forming apparatus 170 through a Dumet wire (not shown) and wiring. The main thermistor element 59*a* detects the temperature of the heater 54 and outputs a detection result to the CPU.

The fixing temperature sensor 59 is located on a surface opposite to the protection glass layer 54*e* over the substrate 54*a*. Further, the fixing temperature sensor 59 is installed in contact with the substrate 54*a* at a position on a reference line "a" (position corresponding to the center) in the longitudinal direction of the heat generating element 54*b*. The CPU is configured to control the temperature at the time of fixing processing based on the detection result of the fixing temperature sensor 59. The above is the description as to the configuration of the fixing temperature sensor 59 being a main thermistor.

As described above, according to the fifth embodiment, the temperature drop at the end portion in the longitudinal direction of each member of the fixing apparatus and the temperature rise at the non-sheet passing portion can be both suppressed.

According to the embodiments, the temperature drop at the end portion in the longitudinal direction of each member of the fixing apparatus and the temperature rise at the non-sheet passing portion can be both suppressed.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-218600, filed Dec. 3, 2019, which is hereby incorporated by reference herein in its entirety.

What is claimed is:

1. A fixing apparatus configured to fix an unfixed toner image borne on a recording material, the fixing apparatus comprising a heater including a heat generating element having a first area, a second area, and a third area, the first area being located on an end portion side in an orthogonal direction orthogonal to a conveyance direction of the recording material and having a first heat generation amount per unit length in the orthogonal direction, the second area being adjacent to the first area in the orthogonal direction and having a second heat generation amount per unit length in the orthogonal direction, the third area being adjacent to the second area in the orthogonal direction and having a third heat generation amount per unit length in the orthogonal direction, wherein the second heat generation amount is larger than the third heat generation amount, and the third heat generation amount is larger than the first heat generation amount, wherein the first area has a first length in the orthogonal direction, the second area has a second length in the orthogonal direction, the third area has a third length in the orthogonal direction, the third length is larger than the second length, and the second length is larger than the first length, wherein the first area has a first width in the conveyance direction, the second area has a second width in the conveyance direction, and the third area has a third width in the conveyance direction, and wherein respective one sides of the first area, the second area, and the third area are lined up as a straight line, and respective positions of the other sides change so that the first width is larger than the third width, and the third width is larger than the second width.

2. The fixing apparatus according to claim 1, wherein the first area, the second area, and the third area of the heat generating element are arranged in the orthogonal direction in order of the first area, the second area, the third area, the second area, and the first area.

3. The fixing apparatus according to claim 1, wherein the first area has a first electric resistance value, wherein the second area has a second electric resistance value, wherein the third area has a third electric resistance value, and wherein the second electric resistance value is larger than the third electric resistance value, and the third electric resistance value is larger than the first electric resistance value.

4. The fixing apparatus according to claim 1, wherein the first width of the first area in the conveyance direction becomes narrower toward an inner side in the orthogonal direction, and wherein the second width of the second area in the conveyance direction becomes wider toward the inner side in the orthogonal direction.

5. The fixing apparatus according to claim 4, wherein an average of the first width of the first area is a first average width, wherein an average of the second width of the second area is a second average width, wherein an average of the third width of the third area in the conveyance direction is a third average width, and wherein the first average width is larger than the third average width, and the third average width is larger than the second average width.

6. The fixing apparatus according to claim 1, further comprising a substrate on which the heat generating element is to be mounted.

7. The fixing apparatus according to claim 6, wherein the heat generating element comprises a plurality of heat generating elements, and wherein the plurality of heat generating elements are arranged symmetrically in a widthwise direction of the substrate which is the conveyance direction.

8. The fixing apparatus according to claim 7, wherein in the conveyance direction, the respective one sides of the plurality of heat generating elements are disposed on an end side of the heater, and the respective other sides of the plurality of heat generating elements are disposed on a center side of the heater.

9. The fixing apparatus according to claim 6, wherein the heat generating element is a first heat generating element having a first element length in the orthogonal direction orthogonal to the conveyance direction, wherein the heater further includes:

a second heat generating element having a second element length shorter than the first element length of the first heat generating element in the orthogonal direction; and a third heat generating element having a third element length shorter than the second element length of the second heat generating element in the orthogonal direction, and wherein in a widthwise direction, which is the conveyance direction, of the substrate, the first heat generating element, the second heat generating element, and the third heat generating element are arranged on the substrate in order of the first heat generating element, the second heat generating element, the third heat generating element, and the first heat generating element.

10. The fixing apparatus according to claim 1, wherein the second area includes an end portion in the orthogonal direction of an area of an image to be formed on a first sheet that is largest among sheets which are each the recording material allowed to be subjected to a fixing processing by the fixing apparatus, and wherein the first area includes an end portion in the orthogonal direction of a second sheet that is second largest after the first sheet.

11. The fixing apparatus according to claim 10, wherein the first sheet is an LTR sheet, and wherein the second sheet is an A4 sheet.

12. The fixing apparatus according to claim 10, wherein the first sheet is an A3 sheet, and wherein the second sheet is an LTR sheet.

13. The fixing apparatus according to claim 1, further comprising:

a first rotary member to be heated by the heat generating element; and a second rotary member configured to form a nip portion together with the first rotary member.

14. The fixing apparatus according to claim 13, wherein the first rotary member is a film.

15. The fixing apparatus according to claim 14, wherein the heater is disposed in an inner space of the film, and wherein the nip portion is formed by the heater and the second rotary member through the film.

16. An image forming apparatus, comprising:

an image forming unit configured to form an unfixed toner image on a recording material; and a fixing apparatus configured to fix the unfixed toner image borne on the recording material, the fixing apparatus comprising a heater including a heat generating element having a first area, a second area, and a third area, the first area being located on an end portion side in an orthogonal direction orthogonal to a conveyance direction of the recording material and having a first heat generation amount per unit length in the orthogonal direction, the second area being adjacent to the first area in the orthogonal direction and having a second heat generation amount per unit length in the orthogonal direction, the third area being adjacent to the second area in the orthogonal direction and having a third heat generation amount per unit length in the orthogonal direction, wherein the second heat generation amount is larger than the third heat generation amount, and the third heat generation amount is larger than the first heat generation amount, wherein the first area has a first length in the orthogonal direction, the second area has a second length in the orthogonal direction, the third area has a third length in the orthogonal direction, the third length is larger than the second length, and the second length is larger than the first length, wherein the first area has a first width in the conveyance direction, the second area has a second width in the conveyance direction, and the third area has a third width in the conveyance direction, and wherein respective one sides of the first area, the second area, and the third area are lined up as a straight line, and respective positions of the other sides change so that the first width is larger than the third width, and the third width is larger than the second width.

17. A heater, comprising:

an elongated substrate; and a heat generating element having a first area, a second area, and a third area, the first area being located on an end portion side in a longitudinal direction of the substrate and having a first heat generation amount per unit length in the longitudinal direction, the second area being adjacent to the first area in the longitudinal direction and having a second heat generation amount per unit length in the longitudinal direction, the third area being adjacent to the second area in the longitudinal direction and having a third heat generation amount per unit length in the longitudinal direction, wherein the second heat generation amount is larger than the third heat generation amount, and the third heat generation amount is larger than the first heat generation amount, the second area has a second length in the longitudinal direction, the third area has a third length in the longitudinal direction, the third length is larger than the second length, and the second length is larger than the first length, wherein the first area has a first width in a widthwise direction orthogonal to the longitudinal direction, the second area has a second width in the widthwise direction, and the third area has a third width in the widthwise direction, and wherein respective one sides of the first area, the second area, and the third area are lined up as a straight line, and respective positions of the other sides change so that the first width is larger than the third width, and the third width is larger than the second width.

18. The heater according to claim 17, wherein the first area, the second area, and the third area of the heat generating element are arranged in the longitudinal direction in order of the first area, the second area, the third area, the second area, and the first area.

19. The heater according to claim 17, wherein the first area has a first electric resistance value, wherein the second area has a second electric resistance value, wherein the third area has a third electric resistance value, and wherein the second electric resistance value is larger than the third electric resistance value, and the third electric resistance value is larger than the first electric resistance value.

20. The heater according to claim 17, wherein the first width of the first area in the widthwise direction becomes narrower toward an inner side in the longitudinal direction, and wherein the second width of the second area in the widthwise direction becomes wider toward the inner side in the longitudinal direction.

21. The heater according to claim 20, wherein an average of the first width of the first area is a first average width, wherein an average of the second width of the second area is a second average width, wherein an average of the third width of the third area in the widthwise direction is a third average width, and wherein the first average width is larger than the third average width, and the third average width is larger than the second average width.

22. The heater according to claim 17, wherein the heat generating element comprises a plurality of heat generating elements, and wherein the plurality of heat generating elements are arranged symmetrically in the widthwise direction of the substrate.

23. The heater according to claim 22, wherein in the widthwise direction, the respective one sides of the plurality of heat generating elements are disposed on an end side of the heater, and the respective other sides of the plurality of heat generating elements are disposed on a center side of the heater.

24. The heater according to claim 17, wherein the heat generating element is a first heat generating element having a first element length in the longitudinal direction, wherein the heater further includes:

a second heat generating element having a second element length shorter than the first element length of the first heat generating element in the longitudinal direction; and a third heat generating element having a third element length shorter than the second element length of the second heat generating element in the longitudinal direction, and wherein in the widthwise direction of the substrate, the first heat generating element, the second heat generating element, and the third heat generating element are arranged on the substrate in order of the first heat generating element, the second heat generating element, the third heat generating element, and the first heat generating element.

* * * * *